US012060706B2

(12) United States Patent
Ciccarello

(10) Patent No.: US 12,060,706 B2
(45) Date of Patent: Aug. 13, 2024

(54) SYSTEM FOR WALL CONSTRUCTION

(71) Applicant: Techo-Bloc Inc., Saint-Hubert (CA)

(72) Inventor: Charles Ciccarello, Saint-Jean-sur-Richelieu (CA)

(73) Assignee: TECHO-BLOC INC., Saint-Hubert (CA)

( * ) Notice: Subject to any disclaimer, the term of this patent is extended or adjusted under 35 U.S.C. 154(b) by 54 days.

(21) Appl. No.: 17/616,837

(22) PCT Filed: Jun. 5, 2020

(86) PCT No.: PCT/CA2020/050776
§ 371 (c)(1),
(2) Date: Dec. 6, 2021

(87) PCT Pub. No.: WO2020/243840
PCT Pub. Date: Dec. 10, 2020

(65) Prior Publication Data

US 2022/0307258 A1 Sep. 29, 2022

Related U.S. Application Data

(60) Provisional application No. 62/857,414, filed on Jun. 5, 2019.

(51) Int. Cl.
*E04B 2/12* (2006.01)
*E02D 29/02* (2006.01)
*E04B 2/02* (2006.01)

(52) U.S. Cl.
CPC ..... *E04B 2/12* (2013.01); *E02D 29/025* (2013.01); *E02D 29/0266* (2013.01); *E04B 2002/0226* (2013.01); *E04B 2002/0256* (2013.01)

(58) Field of Classification Search
CPC ..... E02D 29/025; E02D 29/0266; E04B 2/12; E04B 2/30; E04B 2/36; E04B 2002/0226; E04B 2002/0256; E04C 1/395
USPC ..... 52/604
See application file for complete search history.

(56) References Cited

U.S. PATENT DOCUMENTS 748,603 A * 1/1904 Henry ..... E04B 2/12 122/6 A
1,093,127 A * 4/1914 Haeger ..... E04B 2/12 52/575
1,410,729 A * 3/1922 Balz ..... F27D 1/06 266/283
2,066,268 A * 12/1936 Hohner ..... E04F 13/0803 52/510
3,562,988 A * 2/1971 Wallace ..... E04B 2/12 52/590.3

(Continued)

FOREIGN PATENT DOCUMENTS

WO WO-2010124345 A1 * 11/2010 ..... E02D 29/025

OTHER PUBLICATIONS

Search Report and Written Opinion dated Sep. 2, 2020 of International Application No. PCT/CA2020/050776.

*Primary Examiner* — James M Ference
(74) *Attorney, Agent, or Firm* — Thompson Hine LLP

(57) ABSTRACT

A kit and system for constructing structures including at least one core block, at least one fascia block that connects to the core block by mounting a shelf that extends from a face of the core block with a cut-out section of a face of the fascia block, such that the face of the core block and the face of the fascia block form a gap therein between.

35 Claims, 18 Drawing Sheets

(56) References Cited

U.S. PATENT DOCUMENTS 4,244,665 A * 1/1981 Neumann ..... A01G 9/025 405/286
4,678,192 A * 7/1987 Campbell ..... A63F 9/12 446/124
4,833,856 A * 5/1989 Zwagerman ..... B63B 35/38 52/564
4,916,875 A * 4/1990 Kashiwagi ..... E04F 13/0851 52/302.3
5,315,802 A * 5/1994 Hart ..... E04B 2/08 52/745.1
5,528,873 A * 6/1996 Correia ..... E04B 2/06 405/286
5,634,305 A * 6/1997 Erlanger ..... E04B 2/86 52/235
5,816,749 A * 10/1998 Bailey, II ..... E04C 1/395 52/603
5,820,304 A * 10/1998 Sorheim ..... E02D 29/025 405/262
5,930,964 A * 8/1999 Boehning ..... E04C 1/41 52/375
6,000,183 A * 12/1999 Newman ..... E04F 13/0882 52/311.1
6,234,721 B1 * 5/2001 Cronkhite ..... E02D 29/025 52/610
7,207,146 B1 * 4/2007 Morrell ..... B28B 7/0044 52/561
8,234,828 B2 * 8/2012 MacDonald ..... E02D 29/02 52/391
8,381,478 B2 * 2/2013 Leach ..... E02D 29/025 52/606
9,453,341 B1 * 9/2016 Swierad ..... E01F 8/0005
9,725,900 B2 * 8/2017 Correia ..... E04B 2/32
10,060,124 B2 * 8/2018 Rodenburgh ..... E04B 2/08
10,458,092 B1 * 10/2019 Correia ..... E02D 29/0266
11,505,910 B2 * 11/2022 Bush ..... E02D 29/0266
2006/0096180 A1 * 5/2006 Price ..... E02D 29/025 52/1
2007/0175161 A1 * 8/2007 Sunseth ..... E04C 1/395 52/604
2008/0134615 A1 * 6/2008 Risi ..... E02D 29/025 52/598
2010/0018146 A1 * 1/2010 Aube ..... E04F 13/147 52/562
2011/0146186 A1 * 6/2011 Summers ..... E04B 2/08 52/568
2011/0203212 A1 * 8/2011 Matys ..... E04F 13/0816 52/562
2013/0067845 A1 * 3/2013 MacDonald ..... E04B 2/46 52/745.1
2014/0260029 A1 * 9/2014 Browning ..... E04B 1/04 52/564
2015/0247328 A1 * 9/2015 Correia ..... E04B 2/32 52/745.1
2017/0145687 A1 * 5/2017 Mori ..... E04C 1/39
2017/0356184 A1 * 12/2017 Guerrero ..... E04B 2/02
2018/0209143 A1 * 7/2018 Rodenburgh ..... E04F 13/0835
2018/0245338 A1 * 8/2018 Rodenburgh ..... E04B 2/08
2019/0040602 A1 * 2/2019 Luptak ..... E02D 29/02
2020/0181902 A1 * 6/2020 Lacas ..... E04B 2/36
2022/0307258 A1 * 9/2022 Ciccarello ..... E02D 29/025

* cited by examiner

SYSTEM FOR WALL CONSTRUCTION

CROSS REFERENCE TO RELATED APPLICATIONS

This application is a national stage application under 35 U.S.C. 371 of International Application No. PCT/CA2016/050310, filed Jun. 5, 2020, which in turn claims the benefit under 35 U.S.C. 119(e) of U.S. Provisional Ser. No. 62/857,414, filed Jun. 5, 2019, the contents of each of which are hereby incorporated by reference into the present disclosure.

1. FIELD OF THE INVENTION

The present disclosure relates to a kit and construction system for the construction of structures.

2. BACKGROUND OF INVENTION

When manufacturing construction blocks with concrete, dimension variances in the blocks are typical. These variances may impact the accuracy of the construction blocks when assembling a wall. Different solution have been developed to overcome this problem.

U.S. Pat. Nos. 10,060,124 and 9,453,341 describe a system of core and fascia blocks in which the core blocks and fascia blocks are slipped molded to small variations in the horizontal ledge so that when the wall is installed a continuous aligned horizontal ledge is constructed. However, any variation in the horizontal ledge of the core blocks would make it impossible for the core block and the fascia block to couple. Furthermore, differences in the thickness (i.e. the distance between the back face and the front face of a block) of the fascia blocks would result in a wall having a front face that is not flush.

3. SUMMARY OF THE INVENTION

The present disclosure relates to a kit and a construction system for the construction of structures, including retaining walls, pillars, columns, privacy walls, mortar-free masonry walls, sound barriers.

In one embodiment, the present disclosure provides for a kit for constructing a structure comprising: (a) one or more core blocks, each core block having a front side face, a back side face, a left side face, a right side face, a top side face and a bottom side face, each core block having a shelf extending from a bottom portion of one or more of the front side face, the back side face, the left side face and/or the right side face, and (b) one or more fascia blocks, each fascia block having a front side face, a back side face, a right side face, a left side face, a top side face and a bottom side face, the back side face of each fascia block having a cut-out section, the cut-out section of the fascia block being designed, sized or configured to mount on the shelf of the core block. In one aspect, the shelf is a horizontal shelf.

In one embodiment of the kit, the shelf includes (i) a bottom face which is aligned with the bottom side face of the core block, (ii) a top face, which orthogonally extends for a first distance D1 from the front side face and/or the back side face of the core block, and (iii) a flat front face positioned parallel to the front side face of the core block and/or back face of the core block.

In another embodiment of the kit, the cut-out section of the fascia block includes: (i) a horizontal top wall that orthogonally extends for a second distance D2 from the back side face of the fascia block in a direction towards the front side face of the fascia block, but is terminated before reaching the front side face of the fascia block, and (ii) a vertical back wall orthogonally extending downwards from an end of the horizontal wall of the cut-out that is closest to the front face of the fascia block.

In another embodiment of the kit, the first distance D1 is longer than the second distance D2.

In another embodiment of the kit, the top side face and bottom side face of each core block include at least one groove respectively for interlocking core blocks together in stacked rows.

In another embodiment of the kit, the shelf extends from the front side face and the back side face.

In another embodiment of the kit the shelf extends from the front side face.

In another embodiment of the kit, at least one of the one or more core blocks includes a split line extending from the left side face to the right side face across the top side face of the core block and the bottom side face, and extending across the left and right side faces from the top side face to the bottom side face.

In another embodiment of the kit, the top side face of each core block includes three parallel grooves: a front top groove, a back top groove and a middle top groove disposed between the front top groove and the back top groove, and wherein the bottom side face of each core block includes three parallel bottom grooves: a front bottom groove, a back bottom groove, and a middle bottom groove disposed between the front bottom groove and the back bottom groove, said grooves on the top side face and bottom side face having substantially identical cross-sections.

In another embodiment of the kit, the front top groove is disposed opposite to the front bottom groove in an offset and overlapping relationship, the back top groove is disposed opposite to the back bottom groove in an offset and overlapping relationship, and the middle top groove and the middle bottom groove are disposed in an opposed aligned relationship.

In another embodiment of the kit, the front top groove and back top grove are offset rearwardly a greater distance from the front side face of the core block than the front bottom groove and the back bottom grooves, and wherein the middle top groove and the middle bottom groove are disposed in an opposed aligned relationship.

In another embodiment of the kit, the back side face of at least one of the one or more core blocks includes a cut-out or recess section that extends between the left side face to the right side face of the at least one core block.

In another embodiment of the kit, the bottom face of the shelf includes a protrusion extending from a left side face of the shelf to a right side face of the shelf.

In another embodiment of the kit, the cut-out section of at least one of the one or more fascia blocks has a left side wall which is aligned with the left side face of the fascia block, such that a left end of the cut-out section is closed and a right side end of the cut-out section is open.

In another embodiment of the kit, the cut-out section of at least one of the one or more fascia blocks has a right side wall which is aligned with the right side face of the fascia block, such that a right end of the cut out section is closed and a left end of the cut-out section is open.

In another embodiment of the kit, the cut-out section of at least one of the one or more fascia blocks has a left side wall which is aligned with the left side face of the fascia block, such that a left end of the cut out section is closed and a right side wall which is aligned with the right side face of the fascia block, such that a right end of the cut out section is closed.

In another embodiment of the kit, the top side face of each fascia block includes a groove extending from the left side face of the fascia block to the right side face of the fascia block configured to receive the protrusion of the shelf of the core block.

In another embodiment of the kit, the top side face of each fascia block includes two or more grooves configured for receiving the protrusion of the shelf of the core block.

In another embodiment of the kit, the kit further comprises one or more base blocks, each base block having a front side face, a back side face, a left side face and a right side face, a top side face and a bottom side face, the top side face having a groove that extends from the right side face to the left side face, the groove configured to integrate, assemble or couple with the bottom side face of the core block.

In another embodiment of the kit, the kit further comprises a connector element, and wherein the at least one groove of the top side face and at least one groove of the bottom side face of each core block is configured to receive at least a portion of the connector element therein, said core blocks, when stacked on top of one another to form the structure, having at least one groove of the top side face aligned with one groove of the bottom side face with one or more of said connector elements disposed in and between said aligned grooves to retain said blocks aligned longitudinally and to prevent transverse displacement of said blocks.

In another embodiment of the kit, a gap between the side face of the core block having the shelf and the back side face of the fascia block is formed when the cut-out section of the fascia block is mounted to the shelf of the core block.

In another embodiment, the present disclosure provides for a structure system comprising: (a) a plurality of core blocks, each core block having a front side face, a back side face, a left side face, a right side face, a top side face and a bottom side face, each core block having a shelf extending from a bottom portion of one or more of the front side face, the back side face, the left side face or the right side face, and (b) a plurality of fascia blocks, each fascia block having a front side face, a back side face, a right side face, a left side face, a top side face and a bottom side face, the back side face of each fascia block having a cut-out section, the cut-out section of the fascia block being mounted to the shelf of the core block. In one aspect, the shelf is a horizontal shelf.

In one embodiment of the structure system, the shelf of each core block includes (i) a bottom face which is aligned with the bottom side face of the core block, (ii) a top face, which orthogonally extends for a first distance D1 from the front side face and/or the back side face of the core block, and (iii) a flat front face positioned parallel to the front side face of the core block and/or back face of the core block.

In another embodiment of the structure system, the cut-out section of each fascia block includes: (i) a horizontal top wall that orthogonally extends for a second distance D2 from the back side face of the fascia block in a direction towards the front side face of the fascia block, but is terminated before reaching the front side face of the fascia block, and (ii) a vertical back wall orthogonally extending downwards from an end of the horizontal wall of the cut-out that is closest to the front face of the fascia block.

In another embodiment of the structure system, the first distance D1 is longer than the second distance D2.

In another embodiment of the structure system, the top side face and bottom side face of each core block include at least one groove respectively for interlocking core blocks together in stacked rows.

In another embodiment of the structure system, the shelf extends from the front side face and the back side face of the core block.

In another embodiment of the structure system, the shelf extends from the front side face of the core block.

In another embodiment of the structure system, the shelf extends from the left side face of the core block.

In another embodiment of the structure system, the shelf extends from the right side face of the core block.

In another embodiment of the structure system, at least one of the one or more fascia blocks is mounted to the shelves of the core block to span across a horizontal joint between adjacent core blocks and to span across a vertical joint between adjacent core blocks.

In another embodiment of the structure system, the bottom face of the shelf includes a protrusion extending from a left side face of the shelf to a right side face of the shelf.

In another embodiment of the structure system, the top side face of each fascia block includes a front row groove and a back row groove, the front and back row grooves being parallel to one another and extending from the left side face to the right side face of the top side face of ach fascia block, the front row groove being disposed closer to the front side face of the fascia block relative to the back row groove, each of the front row and back row grooves being configured for coupling with the protrusion of the shelf of the core block.

In another embodiment of the structure system, the top side face of each core block includes three parallel grooves: a front top groove, a back top groove and a middle top groove disposed between the front top groove and the back top groove, and wherein the bottom side face of each core block includes three parallel bottom grooves: a front bottom groove, a back bottom groove, and a middle bottom groove disposed between the front bottom groove and the back bottom groove, said grooves on the top side face and bottom side face having substantially identical cross-sections.

In another embodiment of the structure system, the front top groove is disposed opposite to the front bottom groove in an offset and overlapping relationship, the back top groove is disposed opposite to the back bottom groove in an offset and overlapping relationship, and the middle top groove and the middle bottom groove are disposed in an opposed aligned relationship.

In another embodiment of the structure system, the core blocks are disposed in the assembly such that their middle top grooves in the top face are aligned vertically with the middle bottom grooves to align the front faces of each core block in the assembly in a vertical plane.

In another embodiment of the structure system, the core blocks are disposed in the assembly such that their front top grooves in the top face are aligned vertically with the front bottom grooves to align the front faces of each core block in a battered assembly.

In another embodiment of the structure system, the core blocks are disposed in the assembly such that their back top grooves in the top face are aligned vertically with the back bottom grooves to align the front faces of each core block in a battered assembly.

In another embodiment of the structure system, the core blocks are disposed in the assembly such that the protrusion of the bottom face of the shelf is coupled to the back row groove of the fascia block to align the front faces of the fascia blocks in a vertical plane.

In another embodiment of the structure system, the core blocks are disposed in the assembly such that the protrusion of the bottom face of the shelf is coupled to the front row groove of the fascia block to align the front faces of the fascia blocks in a battered assembly.

In another embodiment, the present disclosure is a core block for a structure system, the core block having a front side face, a back side face, a left side face, a right side face, a top side face and a bottom side face, the core block having a horizontal shelf extending from a bottom portion of one or more of the front side face, the back side face, the left side face or the right side face.

In one embodiment of the core block, the core block further includes a split line extending from the left side face to the right side face across the top side face of the core block and the bottom side face, and extending across the left and right side faces from the top side face to the bottom side face.

In another embodiment of the core block, the top side face of the core block includes three parallel grooves: a front top groove, a back top groove and a middle top groove disposed between the front top groove and the back top groove, and wherein the bottom side face of each core block includes three parallel bottom grooves: a front bottom groove, a back bottom groove, and a middle bottom groove disposed between the front bottom groove and the back bottom groove, said grooves on the top side face and bottom side face having substantially identical cross-sections.

In another embodiment of the core block, the front top groove is disposed opposite to the front bottom groove in an offset and overlapping relationship, the back top groove is disposed opposite to the back bottom groove in an offset and overlapping relationship, and the middle top groove and the middle bottom groove are disposed in an opposed aligned relationship.

In another embodiment of the core block, the front top groove and back top grove are offset rearwardly a greater distance from the front side face of the core block than the front bottom groove and the back bottom grooves, and wherein the middle top groove and the middle bottom groove are disposed in an opposed aligned relationship.

In another embodiment of the core block, the back side face of the core block includes a cut-out or recess section that extends between the left side face to the right side face of the at least one core block.

In another embodiment of the core block, the bottom face of the shelf includes a protrusion extending from a left side face of the shelf to a right side face of the shelf.

In another embodiment of the core block, the top side face and bottom side face of the core block include at least one groove respectively for interlocking core blocks together in stacked rows.

In another embodiment of the core block, the shelf includes (i) a bottom face which is aligned with the bottom side face of the core block, (ii) a top face, which orthogonally extends for a distance from the front side face and/or the back side face of the core block, and (iii) a flat front face positioned parallel to the front side face of the core block and/or back face of the core block.

In another embodiment, the present disclosure provides for a fascia block for a structure system, the fascia block having a front side face, a back side face, a right side face, a left side face, a top side face and a bottom side face, the back side face of the fascia block having a cut-out section, the cut-out section including: (i) a horizontal top wall that orthogonally extends for a distance from the back side face of the fascia block in a direction towards the front side face of the fascia block, but is terminated before reaching the front side face of the fascia block, and (ii) a vertical back wall orthogonally extending downwards from an end of the horizontal wall of the cut-out that is closest to the front face of the fascia block.

In one embodiment of the fascia block, the cut-out section of the fascia block has a left side wall which is aligned with the left side face of the fascia block, such that a left end of the cut-out section is closed and a right side end of the cut-out section is open.

In another embodiment of the fascia block, the cut-out section of the fascia block has a right side wall which is aligned with the right side face of the fascia block, such that a right end of the cut out section is closed and a left end of the cut-out section is open.

In another embodiment of the fascia block, the cut-out section of the fascia block has a left side wall which is aligned with the left side face of the fascia block, such that a left end of the cut out section is closed and a right side wall which is aligned with the right side face of the fascia block, such that a right end of the cut out section is closed.

In another embodiment of the fascia block, the top side face of the fascia block includes a groove extending from the left side face of the fascia block to the right side face of the fascia block.

In another embodiment of the fascia block, the top side face of the fascia block includes two or more grooves.

4. BRIEF DESCRIPTION OF THE DRAWINGS

Figure 1A:
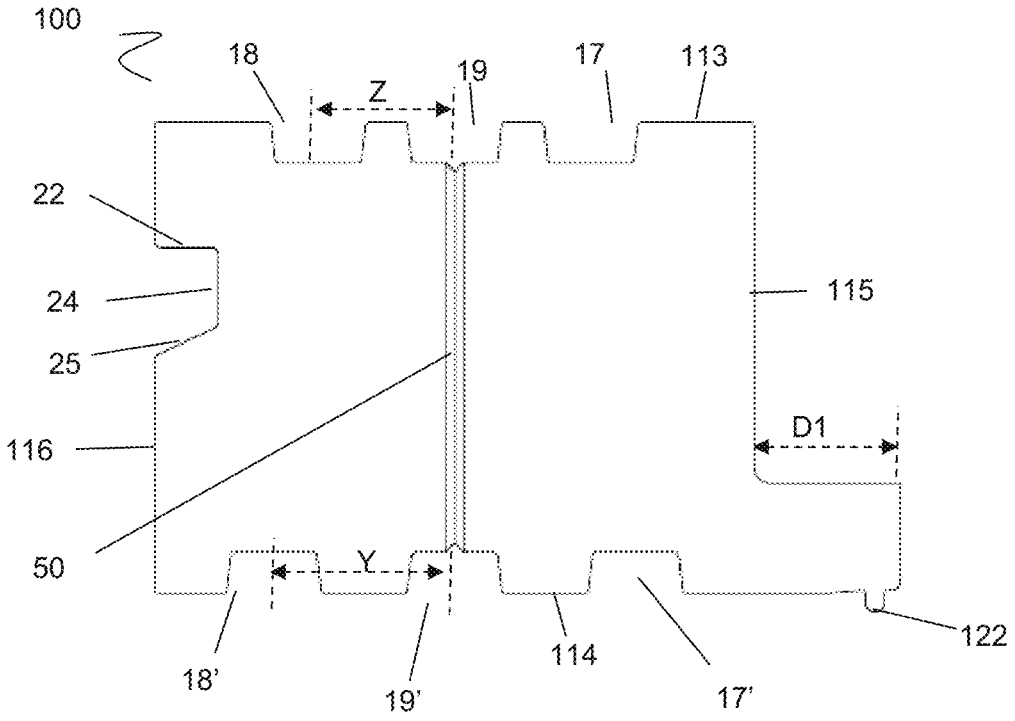
FIG. 1A illustrates a side view of a single core block according to one embodiment.

In the drawings, embodiments of the present disclosure are illustrated by way of example. It is to be expressly understood that the description and drawings are only for the purpose of illustration and as an aid to understanding, and are not intended as a definition of the limits of the invention.

5. DETAILED DESCRIPTION OF THE INVENTION

Definitions

Unless defined otherwise, all technical and scientific terms used herein have the same meaning as commonly understood by one of ordinary skill in the art to which this invention belongs. Also, unless indicated otherwise, except within the claims, the use of "or" includes "and" and vice versa. Non-limiting terms are not to be construed as limiting unless expressly stated or the context clearly indicates otherwise (for example "including", "having" and "comprising" typically indicate "including without limitation"). Singular forms included in the claims such as "a", "an" and "the" include the plural reference unless expressly stated otherwise. All relevant references, including patents, patent applications; government publications, government regulations, and academic literature, and including the priority document, are hereinafter detailed and incorporated by reference in their entireties.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

As used herein, the term "substantially" includes exactly the term it modifies and slight variations therefrom.

Overview

The present disclosure provides for a system of blocks that can be used for the construction of retaining walls, pillars, outside corners, inside corners, chimneys, and other structures consisting of stacked rows of like blocks stacked one on top of the other and oriented in a predetermined manner. As herein shown, the system comprises of a core block and a fascia blocks adapted to be connected to or mounted on the core blocks as it will be described herein below.

Core Blocks

Figure 1B:
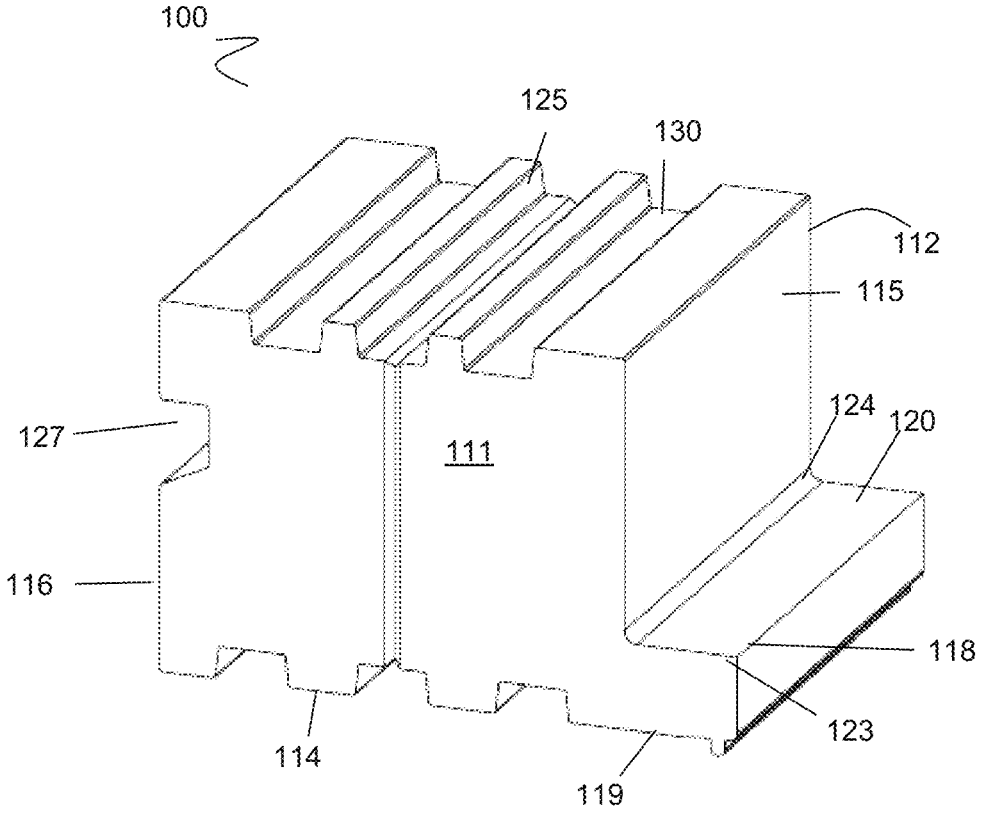
FIG. 1B illustrates a perspective view of a single core block according to one embodiment.
Figure 1C:
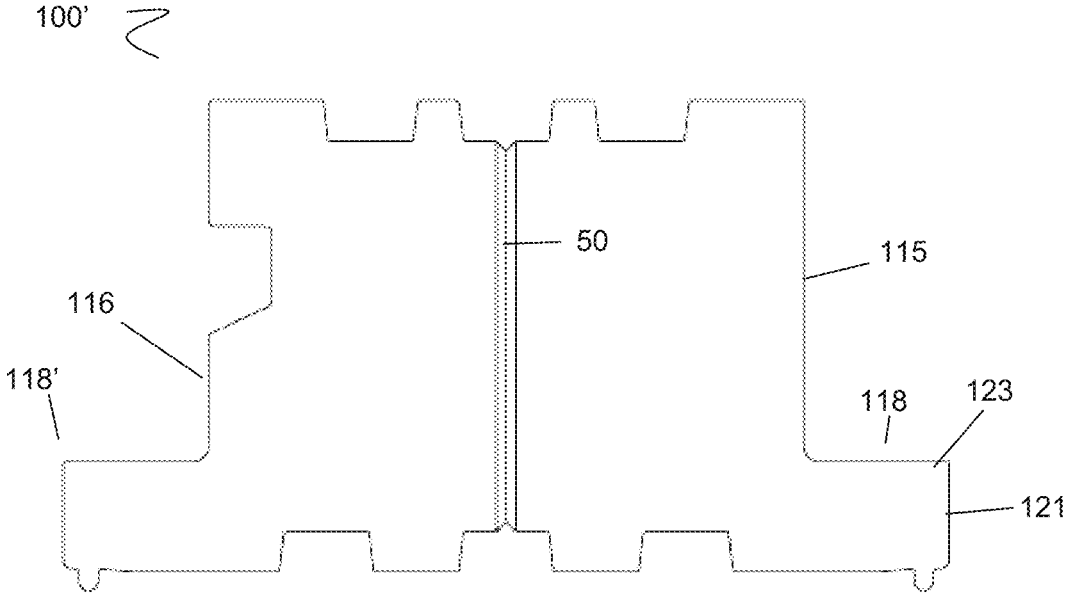
FIG. 1C illustrates a side view of a double core block according to one embodiment.
Figure 1D:
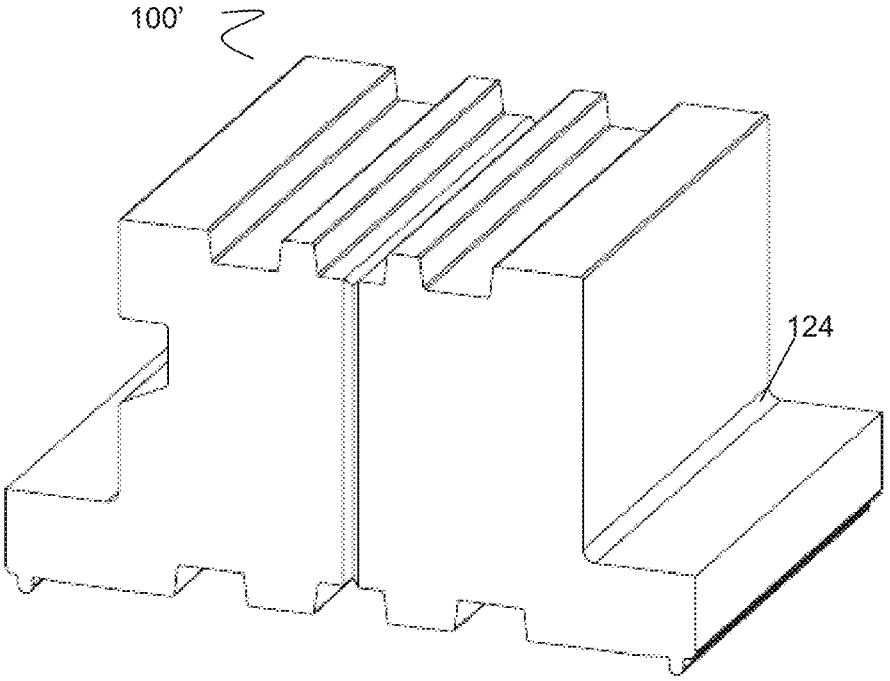
FIG. 1D illustrates a perspective view of a double core block according to one embodiment.
Figure 1E:
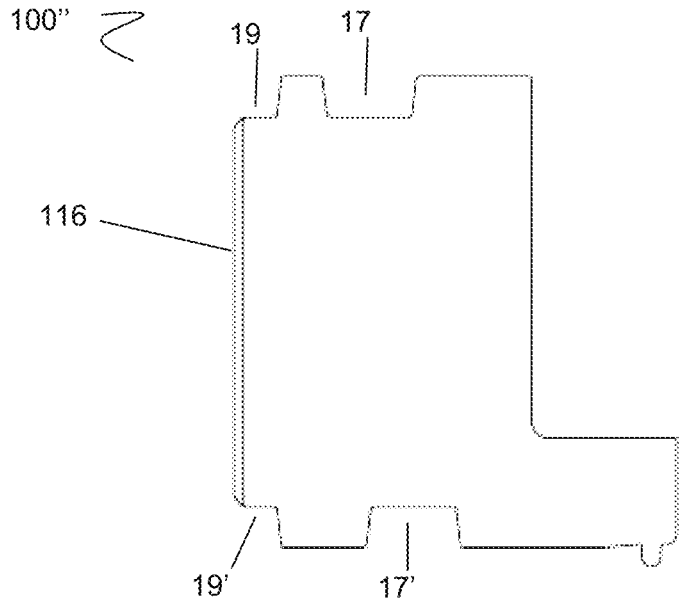
FIG. 1E illustrates a side view of a half or end core block according to one embodiment.
Figure 1F:
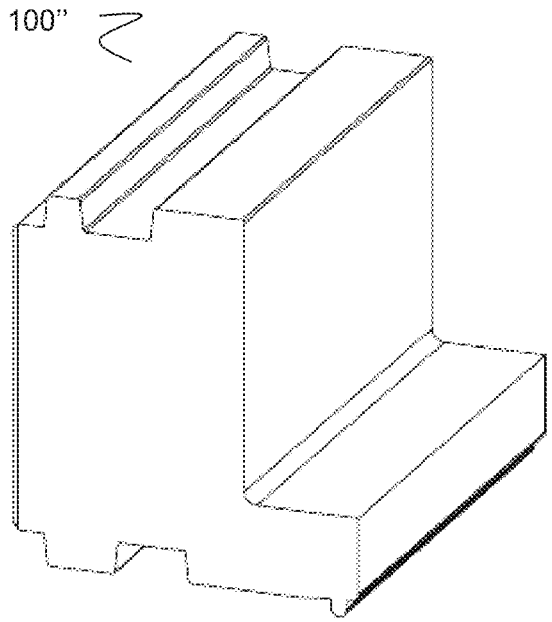
FIG. 1F illustrates a perspective view of a half or end core block according to one embodiment.

FIGS. 1A and 1B show an example of a single face core block 100, FIGS. 1C and 1D show an example of a double face core block 100', and FIGS. 1E and 1F show an example of a half core 100" according to one embodiment. Each core block 100, 100', 100" has a front side face 115, a back side face 116, a left side face 111 (relative to the front side face 115), a right side face 112 (relative to the front side face 115), a top side face 113 and a bottom side face 114.

In some embodiments, the top 113 and bottom 114 side faces include at least one groove respectively that serve for interlocking core blocks together in stacked rows. In one embodiment, the core block 100, 100' includes three grooves 17, 18, 19 on the top side face 113 and three grooves 17', 18' and 19' on the bottom side face 114. However, more or less than three grooves are possible.

A horizontal shelf-like connector 118 extends from a bottom portion of one or more of the front side face, the back side face, the left side face or the right side face of the core blocks. In one embodiment, a shelf-like connector 118 extends from a bottom portion of the front side face 115 of core blocks 100, 100' and 100". In another embodiment, a second horizontal shelf 118' may extend from a bottom portion of the back side face 116 of the double core block 100' as shown in FIGS. 1C and 1D. A description of shelf 118 follows. It should be understood that unless noted otherwise, a similar description applies also to shelf 118" or a shelf that extends from the left side face or the right side face. The shelf 118 has a generally rectangular cross section. In one embodiment, the shelf 118 includes (i) a bottom face 119 which is aligned with, and can extend contiguously from, the bottom side face 114 of the core block 100, (ii) a top face 120, which orthogonally extends for a distance D1 from the front side face 115 of the core block 100 (or from back face 116 in the case of the double core block 100' embodiment), and (iii) a flat front face 121 positioned parallel to the front side face 115 of the core block 100 (or back face 116 in the case of the core block 100'), the flat front face 121 of the shelf 118 forming a straight (i.e. 90°) corner 123 with the flat top face. The top face 120 of the shelf 118 forms a generally rounded corner 124 with the front face 115 of the core block 100. In another embodiment, the corner between the front face 115 of the core block and the top face of the shelf is straight (i.e. 90°).

In one embodiment, the bottom face 119 of the shelf 118 includes a horizontal (extending between the left side face 111 and the right side face 112) protrusion or male connector 122 which can be generally rounded (U-shape). In another embodiment, the bottom face of the shelf includes a horizontal groove. In another embodiment, the bottom face of the shelf includes a horizontal protrusion and a horizontal groove. In another embodiment, the bottom face of the shelf is flat (i.e. no protrusion or grooves).

The grooves or recesses 17, 18 and 19 disposed on the top side face 113 and the grooves or recesses 17', 18' and 19' disposed on the bottom side face 114 of the core block 100, 100', extend horizontally between the left side face 111 to the right side face 112 of the core block 10*o*, 100'.

Figure 4A:
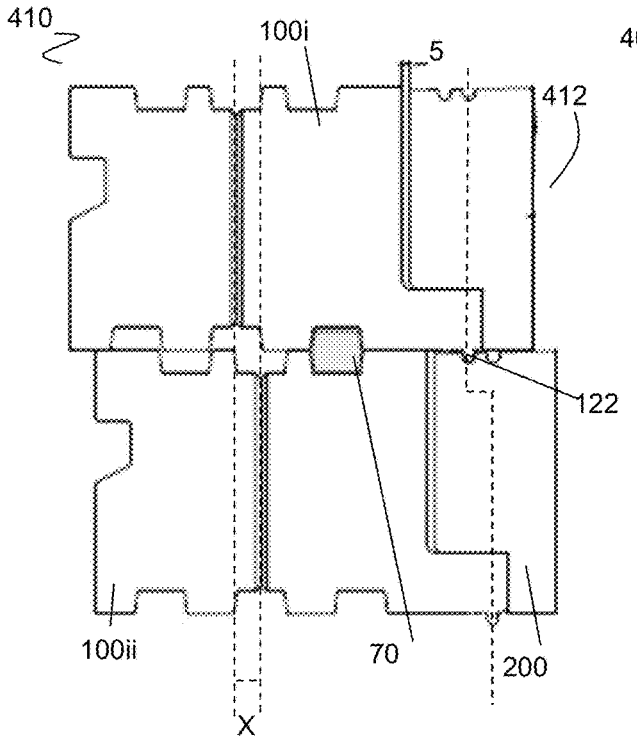
FIG. 4A illustrates a structure having an offset or slopping (battered) front according to one embodiment.

The grooves have a bottom wall 130 and opposed side walls 125. As seen in FIGS. 1A-C, the top groove or recess 17, 18, 19 are disposed generally opposite to the bottom groove or recess 17', 18', 19' respectively as described next. Groove 17 is offset rearwardly, a greater distance from the front side face 115 than the bottom groove or recess 17'. Bottom groove 18' is offset rearwardly, a greater distance from the front side face 115 than the top groove or recess 18. Top groove 19 lies between grooves 17 and 18, while bottom groove 19' lies between grooves 17' and 18'. Grooves 19 and 19' are disposed in opposed aligned relationship. In embodiments, the distance between the middle of the groove 18 and the middle of groove 19 is Z (see FIG. 1A), which is the same as the distance between the middle of groove 19 and the middle of groove 17. The distance between the middle of the groove 18' (i.e. the middle point between the two opposed side walls 125) and the middle of groove 19' is Y (see FIG. 1A), which is the same as the distance between the middle of groove 19' and the middle of groove 17'. Y can be larger than Z. The difference between Y and Z is X, as shown in FIG. 4A.

In embodiments, the grooves 17, 17', 18, 18', 19, 19' have their bottom walls 130 disposed parallel to the top and bottom side faces 113, 114, and their side walls 125 can be outwardly divergent whereby to define a semi-hexagonal cross-section, or can be disposed parallel to the front and back side faces 115, 116 of the core block 100 to define a semi-square. In the semi-hexagon embodiment, when opposed grooves, such as groove 17 is aligned with the recess 17' in a stack row as shown in FIG. 4A, these grooves form a hexagon to receive therein an elongated connector element 70, which is of hexagonal cross-section. The cross-section of the elongated connector member 70 is slightly smaller than the cross-section of the juxtaposed grooves 17, 17' whereby not to provide any interference. These connectors 70 prevent transverse displacement of rows of blocks when stacked one on top of each other and keeps them in longitudinal alignment.

In the semi-square embodiment, the grooves may be of rectangular cross section or any other suitable cross section whereby to receive a portion of an elongated connector element of square cross-section.

In one embodiment, the back side face 116 of core blocks 100, 100' includes a cut-out or recess section 127 designed for easy handling and/or pick-up of the core block. In one embodiment, the cut-out section 127 includes a top wall 22, a side wall 24 and a bottom wall 25. The cut-out section 127 extends between the left side face 111 to the right side face 112 of the core block 100, 100'. The back side face 116 of half core block 100" is generally flat without a cut-out recess section.

In another embodiment, the core block 100, 100' includes a split line 50, to facilitate splitting the back side face 116 from the front side face 115 of the core block 100, 100'. The split line 50 is a fractural indication, such as grooves, on the outside of the block running horizontally across the top side face 113 along the bottom wall of the groove 19, and the bottom side face 114 along the bottom wall of groove 19' from the left side face 111 to the right side face 112, and then continuing vertically across the left and right side faces 111, 112 from the top side face 13 to the bottom side face 114. A half or end core block is depicted in FIGS. 1E and 1F. When splitting a full core block 100, 100' into two half core blocks, one half core block will retain grooves 17, 17' and half of grooves 19, 19', while the other half core block will retain grooves 18, 18' and the other corresponding half of grooves 19, 19'.

Fascia Block

Figure 2A:
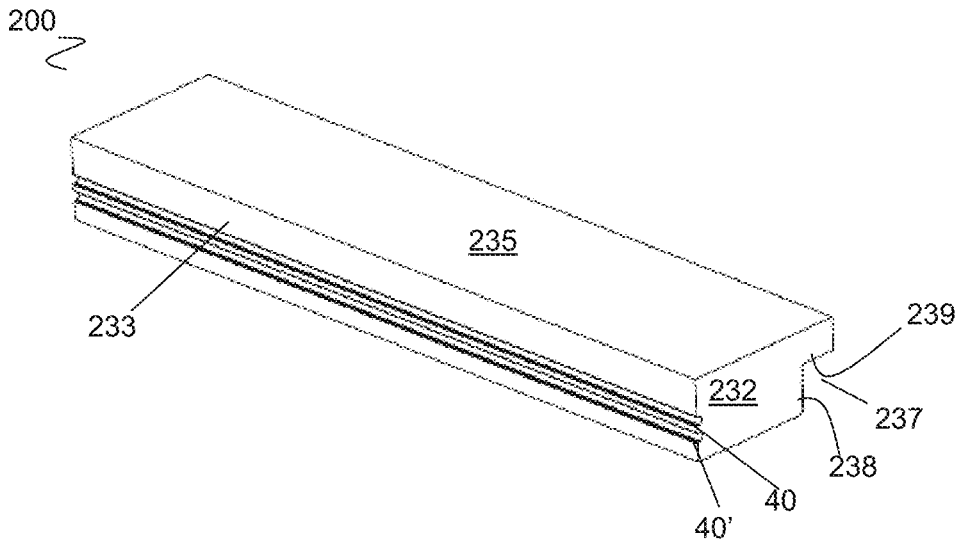
FIGS. 2A to 2C illustrate a perspective view from the front (2A), a side view (2B) and a perspective view from the back (2C) of a fascia core block according to one embodiment.
Figure 2B:
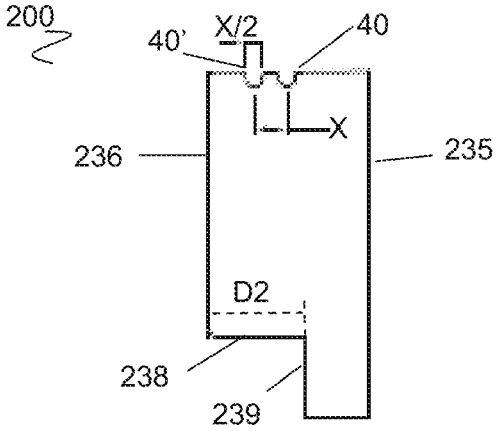
Figure 2C:
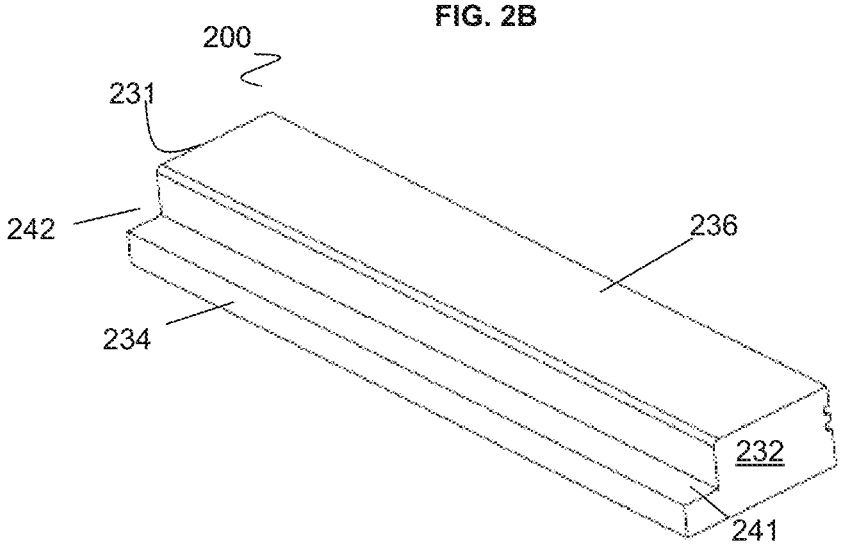

FIGS. 2A, 2B and 2C shows an example of a standard fascia or covering block 200 according to one embodiment. Each fascia block 200 includes a front side face 235, a back side face 236, a right side face 231 (relative to the front side face 235), a left side face 232 (relative to the front side face 235), a top side face 233, and a bottom side face 234.

The back side face 236 of the fascia block 200 includes a cut-out section 237. In one embodiment, the cut-out 237 includes: (i) a horizontal wall 238 that orthogonally extends for a distance D2 from the back side face 236 of the fascia block 200 in a direction towards the front side face 235 of the fascia block, but is terminated before reaching the front side face 235 of the fascia block 200, and (ii) a vertical back wall 239 orthogonally extending downwards from an end of the horizontal wall 238 of the cut-out 237 that is closest to the front face 35 of the fascia block 200, thereby forming a 90 degree angle in relation to the horizontal wall of the cut-out. In a preferred embodiment D1 is longer than D2. In another embodiment, D1 and D2 are of equal length. In another embodiment, D1 is longer than or equal to D2. The back side face 236 extends vertically between the top side face 236 to the horizontal wall 238 of the cut-out section 237. The left side face 232 and the right side face 231 extend between the top side face 233 to the bottom side face 234, or between the top side face 233 to the horizontal wall 238 of the cut-out 237. As such, the cut-out section 237 includes an open left side end 241 and an open right side end 242.

In one embodiment, the top side face 233 of the fascia block 200 includes at least one groove or female connector 40, 40', which can be rounded (U-shaped). In the figures two grooves are depicted: a front groove 40 (closest to the front side face 235) and a back groove 40' (closest to the back side face 236). The distance from the middle of one groove 40 to the middle of the next groove 40' is X (i.e. the difference between Y and Z as explained above). Each groove 40, 40' has a diameter of X/2. Grooves 40, 40' are configured to receive the protrusion 122 of the core block in a male/female interaction.

In another embodiment, the top side face of the fascia block includes a horizontally disposed protrusion designed to couple with a corresponding groove or recess on the bottom side face of the shelf of the core block in a male/female interaction.

Figure 2D:
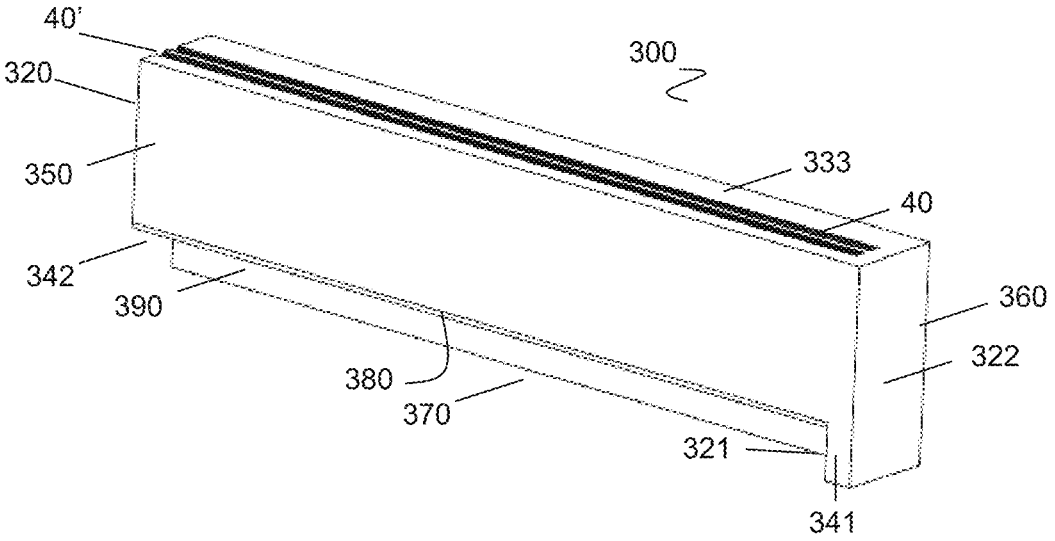
FIG. 2D illustrates a perspective view from the back of a fascia block right end according to one embodiment.

FIG. 2D depicts a fascia right end 300. In this embodiment the cut out section 370 includes (i) a horizontal wall 380 that orthogonally extends for the distance D2 illustrated in FIG. 2B from the back side face 350 of the fascia block 300 in a direction towards the front side face 360 of the fascia block 300, but is terminated before reaching the front side face 360 of the fascia block 300, and horizontally extends from the right side face 320 in a direction towards the left side face 322, but is terminated before reaching the left side face 322, and (ii) a vertical back wall 390 orthogonally extending downwards from an end of the horizontal wall 380 of the cut-out 370 that is closest to the front face 360 of the fascia block 300, thereby forming a 90 degree angle in relation to the horizontal wall of the cut-out. In addition, the cut out section 370 includes a left side wall 321. As such, in this embodiment, the left end 341 of the fascia block 300 is closed, while the right side end 342 is open.

In this embodiment, the grooves 40, 40' extend along the top side face 333 from the right side face 320 towards the left side face 322 but is terminated before reaching the left side face 322. As such, the left ends of grooves 40, 40' are closed, while the right side ends of grooves 40, 40' are open.

Figure 2E:
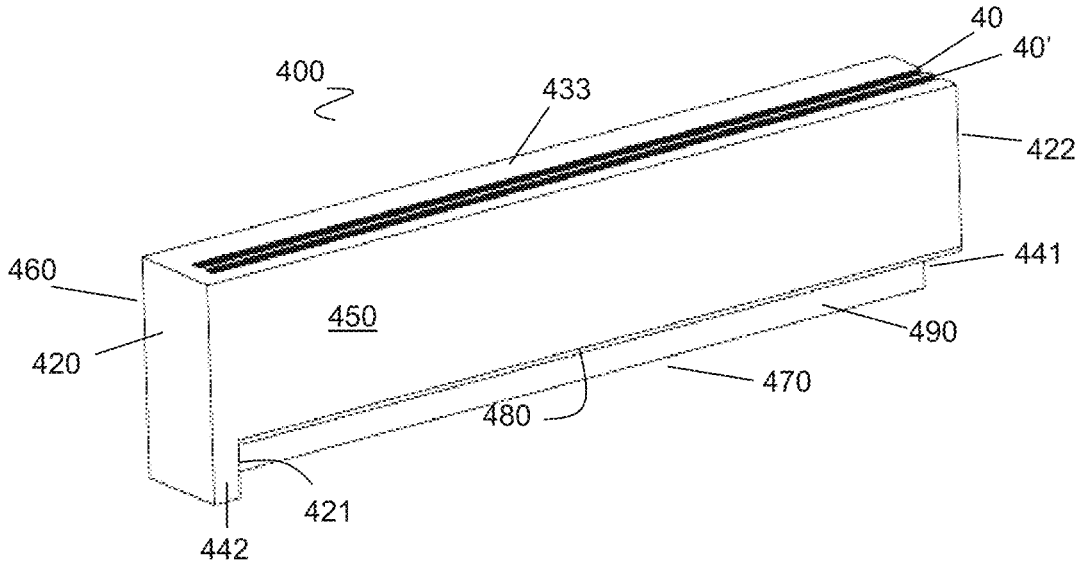
FIG. 2E illustrates a perspective view from the back of a fascia block left end according to one embodiment.

FIG. 2E depicts a fascia left end 400. In this embodiment the cut out section 470 includes (i) a horizontal wall 480 that orthogonally extends for the distance D2 from the back side face 450 of the fascia block 400 in a direction towards the front side face 460 of the fascia block 400, but is terminated before reaching the front side face 460 of the fascia block 400, and horizontally extends from the left side face 422 in a direction towards the right side face 420, but is terminated before reaching the right side face 420, and (ii) a vertical back wall 490 orthogonally extending downwards from an end of the horizontal wall 480 of the cut-out 470 that is closest to the front face 460 of the fascia block 400, thereby forming a 90 degree angle in relation to the horizontal wall of the cut-out. In addition, the cut out section 470 includes a right side wall 421. As such, in this embodiment, the right end 442 of the fascia block 400 is closed, while the left side end 441 is open. In this embodiment, the grooves 40, 40' on the top side face 433 extend along the top side face 433 from the left side face 422 towards the right side face 420 but they are terminated before reaching the right side face 420. As such, the right ends of grooves 40, 40' are closed, while the left side ends of grooves 40, 40' are open.

Figure 2F:
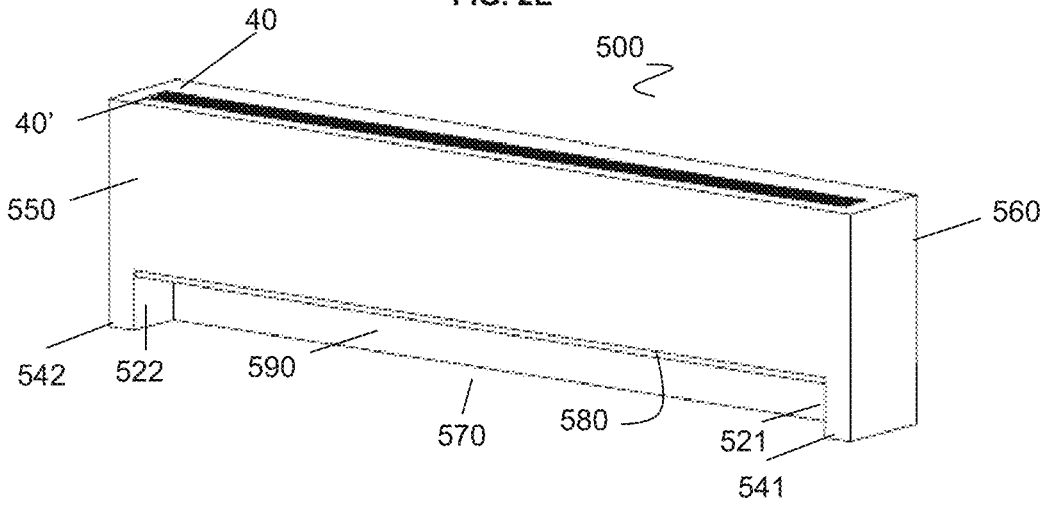
FIG. 2F illustrates a fascia block having closed right and left ends according to one embodiment.

FIG. 2F depicts a fascia block 500 having a cut out section with both ends closed. Fascia block 500 may also be referred to as fascia pillar. In this embodiment the cut out section 570 includes (i) a left side wall 521, (ii) a right side wall 522, (iii) a horizontal wall 580 that orthogonally extends for the distance D2 from the back side face 550 of the fascia block 500 in a direction towards the front side face 560 of the fascia block 500, but is terminated before reaching the front side face 560 of the fascia block 500, and that horizontally extends between the right side wall 522 and the left side wall 521, and (iv) a vertical back wall 590 orthogonally extending downwards from an end of the horizontal wall 580 of the cut-out 570 that is closest to the front face 560 of the fascia block 500, thereby forming a 90 degree angle in relation to the horizontal wall of the cut-out. As such, in this embodiment, the right end 542 and the left side end 541 of the cut out 570 of the fascia block 500 are closed, and the right and left ends of grooves 40, 40' are closed.

Figure 2G:
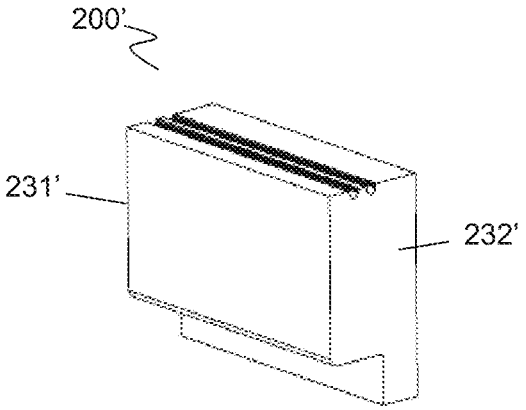
FIG. 2G illustrates a perspective view from the back of a fascia end block.

FIG. 2G depicts an embodiment of a fascia end block 200'. Fascia end block 200' includes the same design as the standard fascia 200 shown in FIGS. 2A to 2C, except that the distance between the right side face 231' and the left side face 232' is relatively shorter than the distance between the right side face 231 and the left side face 232 of the standard fascia block 200.

Base

Figure 3A:
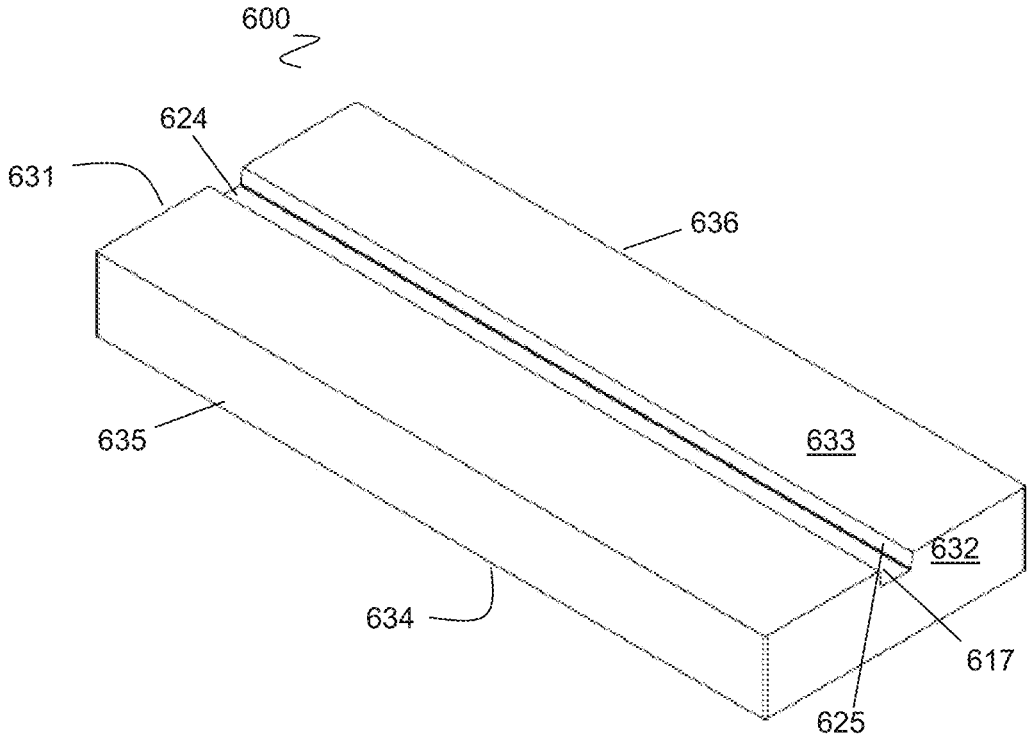
FIGS. 3A to 3B illustrate a perspective view (3A) and a top view (3B) of a base block according to one embodiment.
Figure 3B:
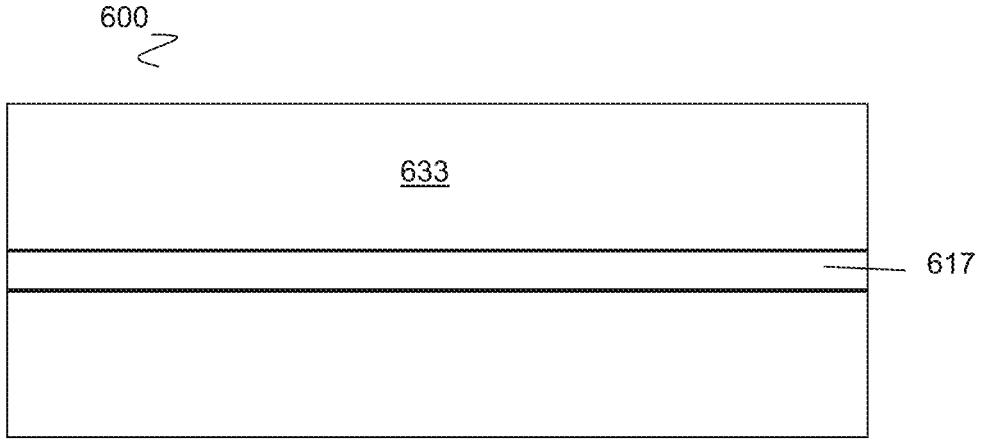
Figure 12:
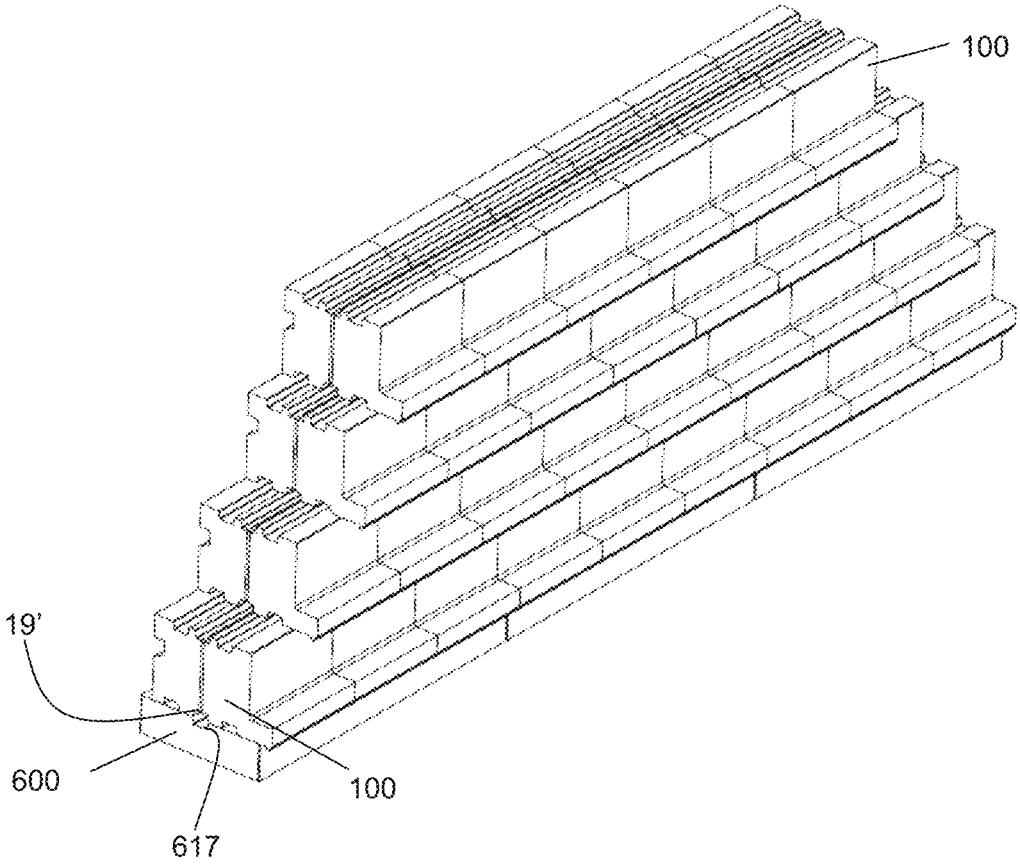
FIG. 12 illustrates a structure of single core blocks supported by a base according to one embodiment.

FIGS. 3A and 3B depict a core base 600. Each core base block 600 includes a front side face 635, a back side face 636, a left side face 631 (relative to the front side face 635), a right side face 632 (relative to the front side face 635), a top side face 633 and a bottom side face 634. The top side face 633 includes a groove 617 that extends between the right side face 632 and the left side face 631 that serves for interlocking with a core block 100 resting on the base 600 as shown in FIG. 12.

The groove 617 includes a bottom wall 624 and opposed side walls 625. The groove 617 has its bottom wall 625 disposed parallel to the top and bottom side faces 633, 634, and their side walls 625 are outwardly divergent whereby to define a semi-hexagonal cross-section. When a recess 617 is aligned, for example, with the recess 19' of a core block, such as core block 100 as shown in FIG. 12, these recesses form a hexagon to receive therein an elongated connector element 40, which is of hexagonal cross-section. The cross-section of the elongated connector member 40 is slightly smaller than the cross-section of the juxtaposed recesses 617, 19' whereby not to provide any interference. These connectors 40 prevent transverse displacement of rows of blocks when stacked one on top of each other and keeps them in longitudinal alignment.

In another embodiment, the opposed side walls of the groove of the base can be disposed parallel to the front and back side faces of the core base to define a semi-square. In the semi-square embodiment, the groove of the core base may be of rectangular cross section or any other suitable cross section whereby to receive a portion of an elongated connector element of square cross-section.

Manufacture

In some embodiments, the core, fascia and base blocks may be manufactured according to methods and processes known in the art. In one embodiment, the core, fascia and base blocks may be made of concrete. The core, fascia and base blocks may be precast concrete blocks, however any other suitable material may be used to manufacture the core, fascia and base blocks described herein.

Assembly of Core Block and Fascia Block

With reference to FIGS. 1 to 2 and FIGS. 4A and 4B, the cut-out 237 of the fascia block 200 is designed, sized or configured to mount, connect, interlock, integrate or couple with the shelf 118 of the core block 100. In one embodiment, the cut-out 237 of the fascia block 200 mounts to the shelf 118 of the core block 100 such that the horizontal wall 238 of the cut-out 237 rests onto the top face 120 of the shelf 118 of the core block 100, thereby mounting the fascia block 200 to the core block 100. In one embodiment, a gap 5 between a side face of the core block that has a shelf and the back side face of the fascia block is formed when the fascia block is mounted to the core block. In one embodiment, the gap 5 is formed by having D1 longer than D2. However, other designs may be implemented to form the gap. These gaps 5 can be consistently maintained when core blocks and fascia blocks are stacked to form a structure (i.e. a wall, a retaining wall, a pillar, columns, chimneys and so forth). As such the rear face of the fascia block does not come into direct contact with the face of the core block having the shelf 118 when a structure is assembled using the blocks described in this disclosure. This gap may be used to accommodate unintended manufacturing differences in the thickness (distance between the back face and the front face) of the fascia blocks to ensure the front face of a wall formed by the blocks is flush. The size of the gap 5 may therefore not be consistent for each integration of fascia block and core block. The gap 5 may also serve to prevent efflorescence.

In one embodiment, each rounded groove 40, 40' of the top side face 233 of the fascia block 200 is designed to receive the at least one rounded (U-shaped) protrusion 122 on the bottom face 119 of the shelf 118 of the core block 100 when the fascia block 200 is combined with or coupled to the core block 100 via integration of the shelf 118 and cut-out 237.

Figure 4B:
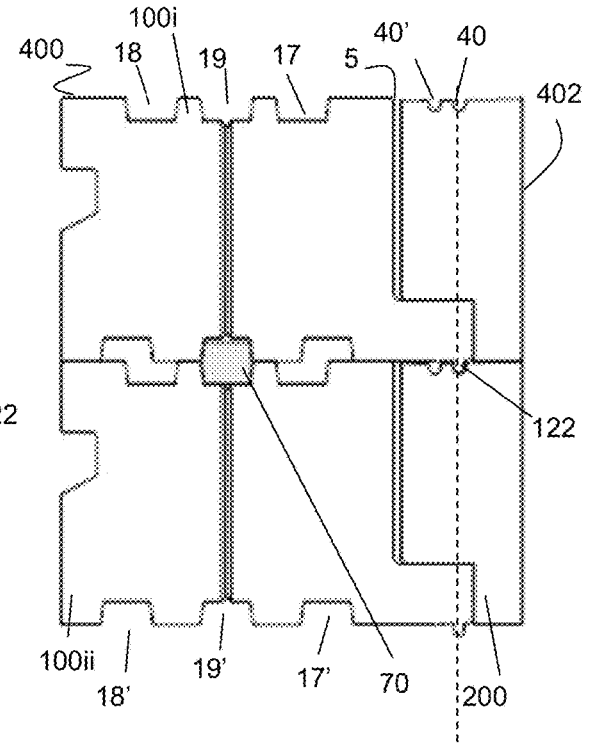
FIG. 4B illustrates a structure having a straight front according to one embodiment.

Referring now to FIGS. 4A and 4B, there is shown embodiments of the manner in which the blocks are coupled and stacked.

FIG. 4B illustrates a structure 400 having a straight front face 402. In this embodiment, a first block 100*i* is stacked on top of a second block 100*ii*. If the construction is to have a straight front face 402, then the middle groove 19 of block 100*ii*, is disposed in juxtaposed and aligned with groove 19' of block 100*i*, while the grooves 17, 17' are offset, as shown in FIG. 4B. No connector are provided in the grooves 17, 17', which are offset a distance X, i.e. the distance between the centers of grooves 40, 40'. In this straight embodiment the rounded (U-shaped) protrusion 122 on the bottom face 119 of the shelf 118 of the core block 100 interacts with rounded front groove 40 of the top side face 233 of the fascia block 200.

FIG. 4A illustrates a structure 410 having an inclined, sloped or offset front face 412 to create a battered structed. In this embodiment, a first block 100*i* is stacked on top of a second block 100*ii*. The groove 17 (i.e. the groove closest to the front face of the core block) of core block 100*ii*, is disposed in juxtaposed alignment with groove 17' of core block 100*i*. In this set back embodiment the rounded (U-shaped) protrusion 122 on the bottom face 119 of the shelf 118 of the core block 100 interacts with rounded back groove 40' of the top side face 233 of the fascia block 200. No connector are provided in the grooves 19, 19'. Note that the split line of the two blocks of structure 410 are offset a distance X, i.e. the distance between the centers of grooves 40, 40'.

As such, by selecting the positon of the grooves 17, 18, 19, the same block can be used to construct structures of differing batter.

The blocks of the present disclosure may be used to construct walls, retaining walls (see FIGS. 5 and 6), pillars as illustrated in FIGS. 7A to 7G, inside and outside corner assemblies as illustrated in FIGS. 8A to 8F, and a variety of other structures such as chimneys, privacy walls, mortar-free masonry walls, sound barriers and so forth.

The system of the present disclosure allow the construction of a variety of structures.

Figure 5:
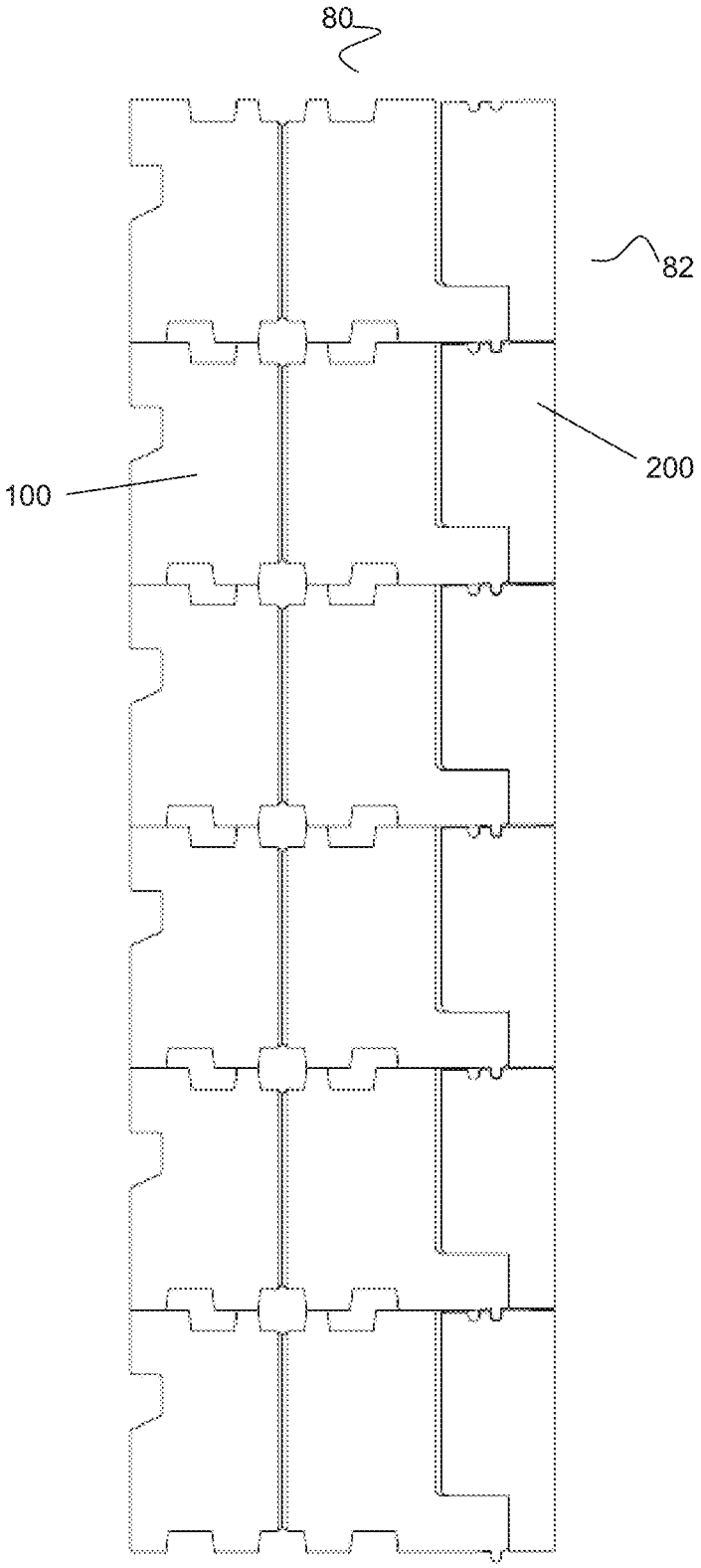
FIG. 5 illustrates a structure having a straight front using single core blocks and fascia blocks according to one embodiment.

FIG. 5 illustrates a structure 80 having a straight front 82 using single core blocks 100 and fascia blocks 200.

Figure 6:
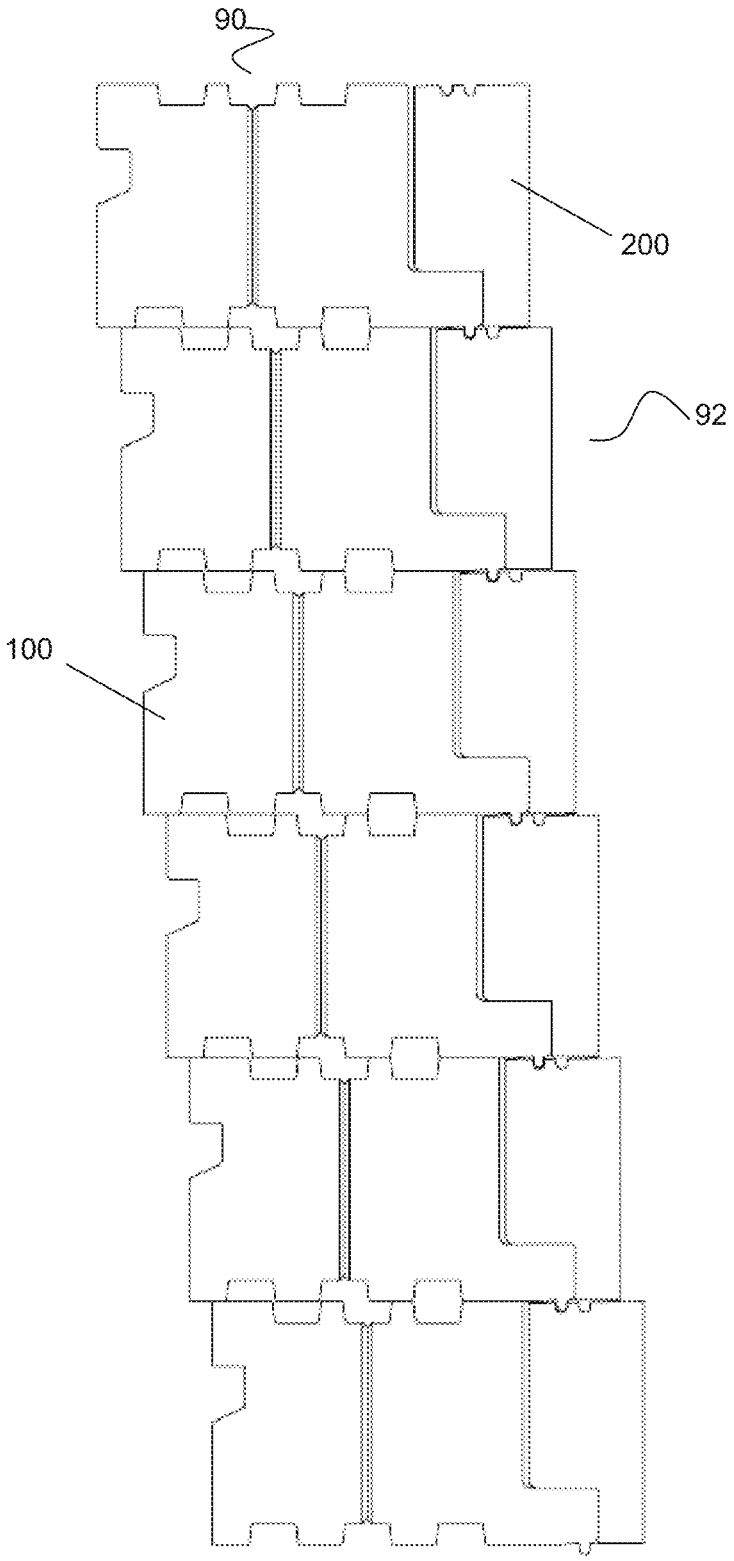
FIG. 6 illustrates a structure having an offset front using single core blocks and fascia blocks according to one embodiment.

FIG. 6 illustrates a structure 90 having an offset front 92 using single core blocks 100 and fascia blocks 200.

Figures 7A, 7B:
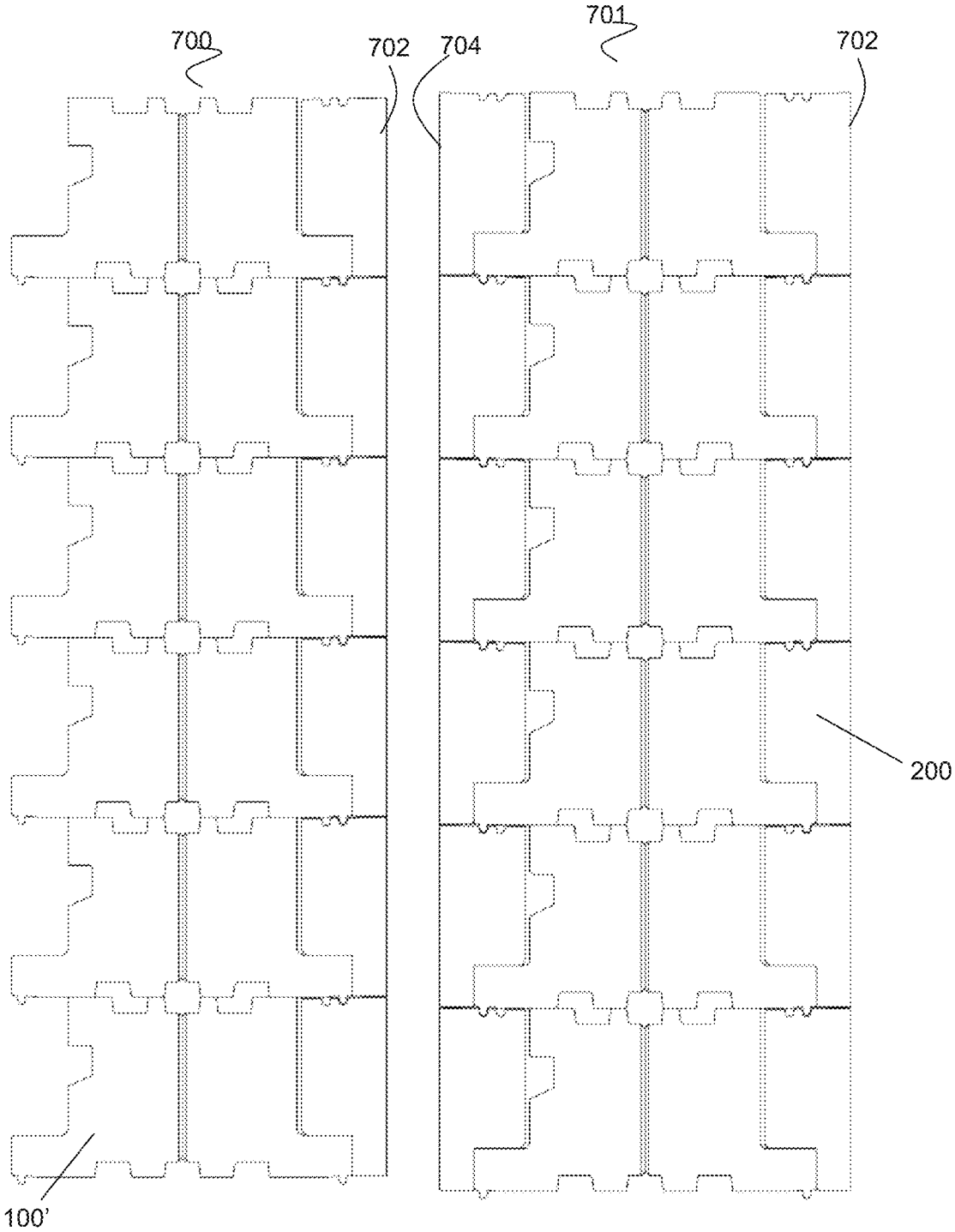
FIG. 7A illustrates a structure having a single straight front face using double core blocks according to one embodiment.
FIG. 7B illustrates a structure having a straight front face and a straight back face using double core blocks according to one embodiment.

FIG. 7A illustrates a structure 700 having a single straight front face 702 using double core blocks 100'. Using the double core blocks 100' can lead to a wall 701 having a straight front face 702 and a straight back face 704 (see FIG. 7B).

Figure 8:
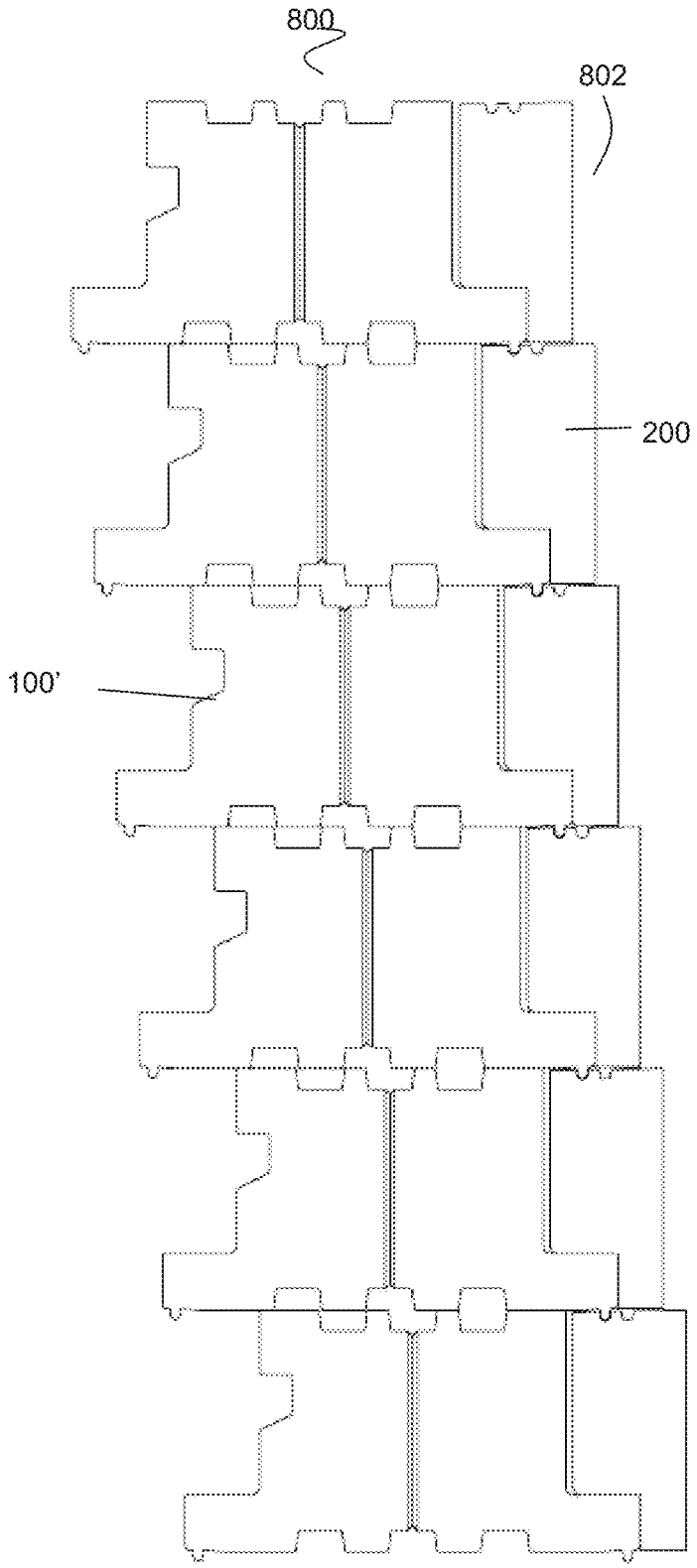
FIG. 8 illustrates a structure having a setback or offset front face using double core blocks according to one embodiment.
Figure 9A:
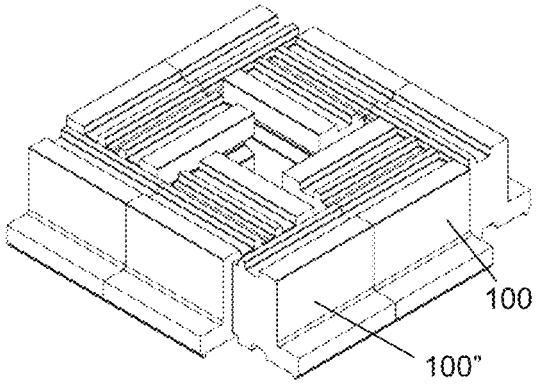
FIGS. 9A to 9G illustrate the construction of a pillar using single core blocks and half core blocks according to one embodiment.
Figure 9B:
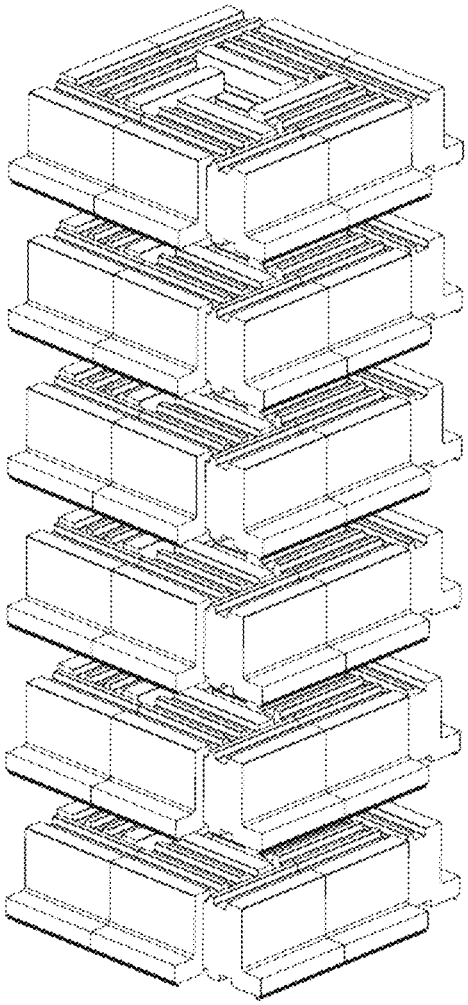
Figure 9C:
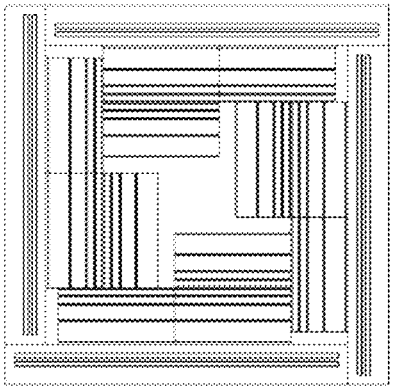
Figure 9D:
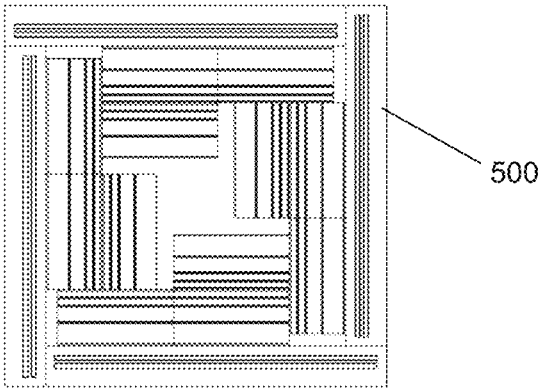
Figure 9E:
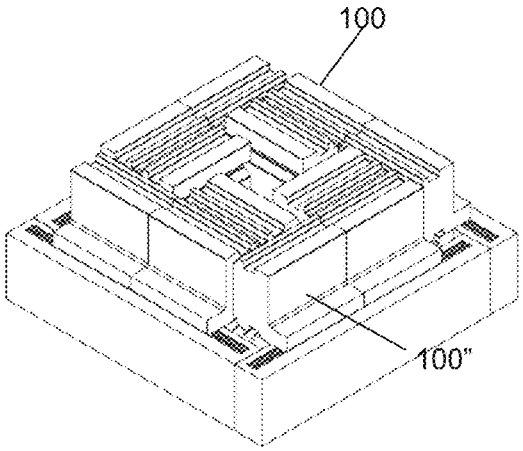
Figure 9F:
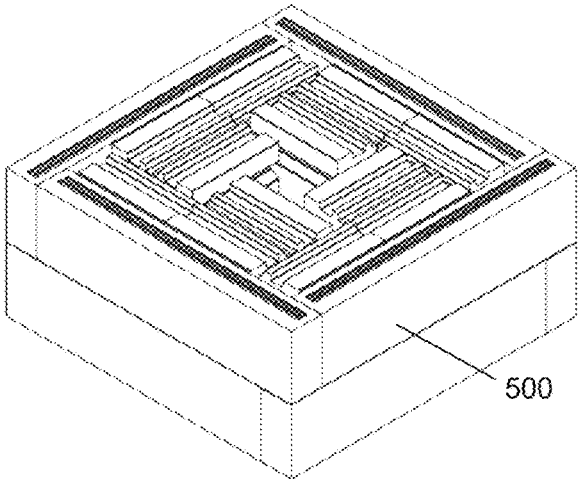
Figure 9G:
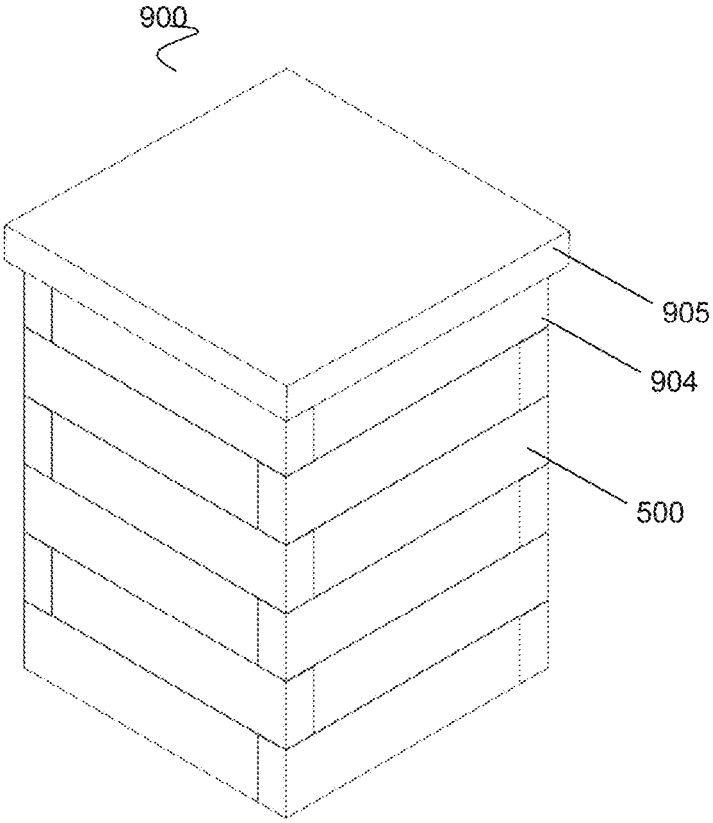

FIG. 8 illustrates a structure 800 having a setback or offset front face 802 using double core blocks 100'.

FIGS. 9A to 9E illustrate the construction of a pillar 900 using single core blocks 100 and half core blocks 100" to erect the core of the pillar 900, and fascia pillars 500 to create the front face of the pillar 900. The top of the pillar 900 may be closed with a component 905 that rests on the top row 904 of the pillar 900.

Figure 10A:
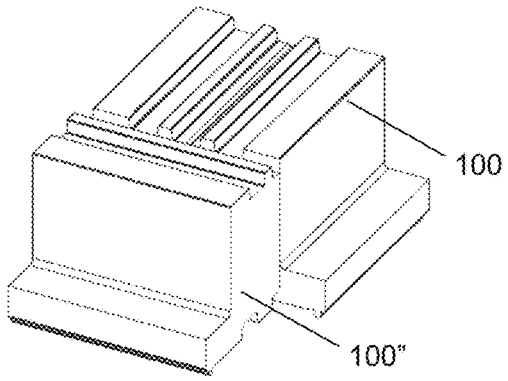
FIGS. 10A to 10E illustrate the construction of a corner assembly using single core blocks and half core blocks, right end and left end fascia blocks according to one embodiment.
Figure 10B:
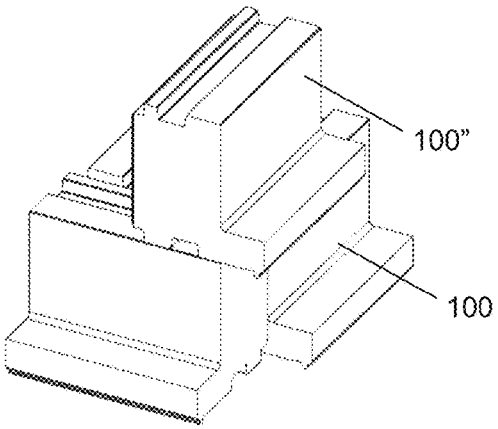
Figure 10C:
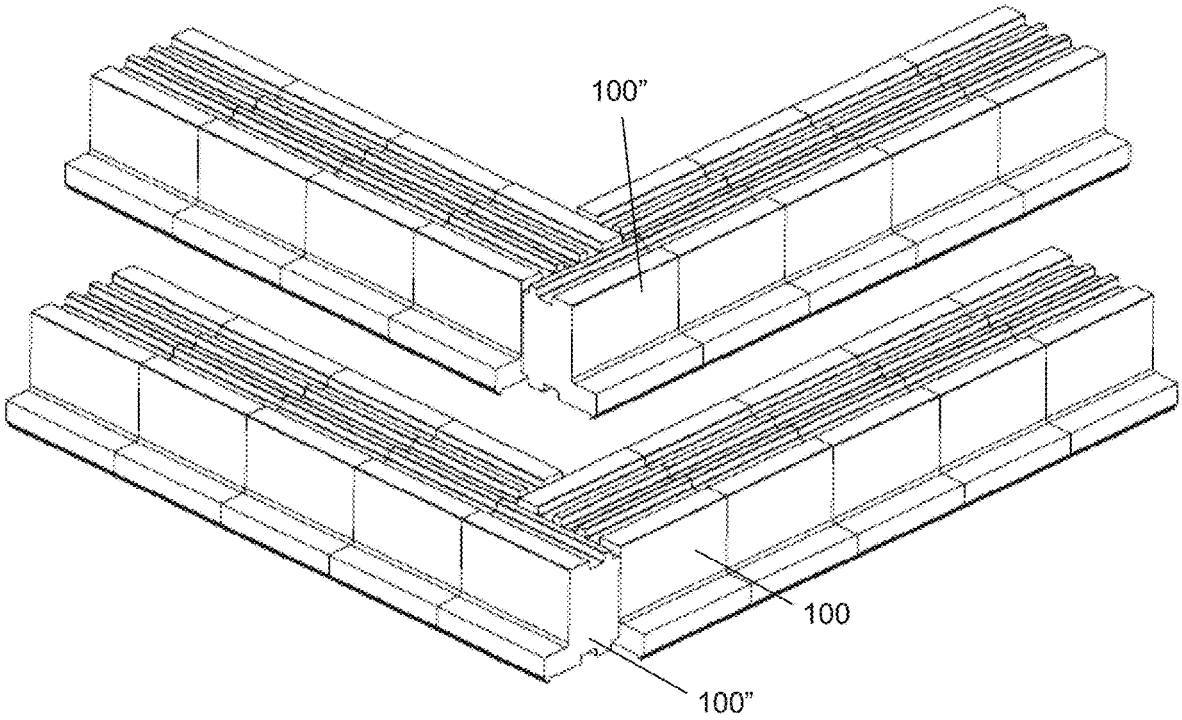
Figure 10D:
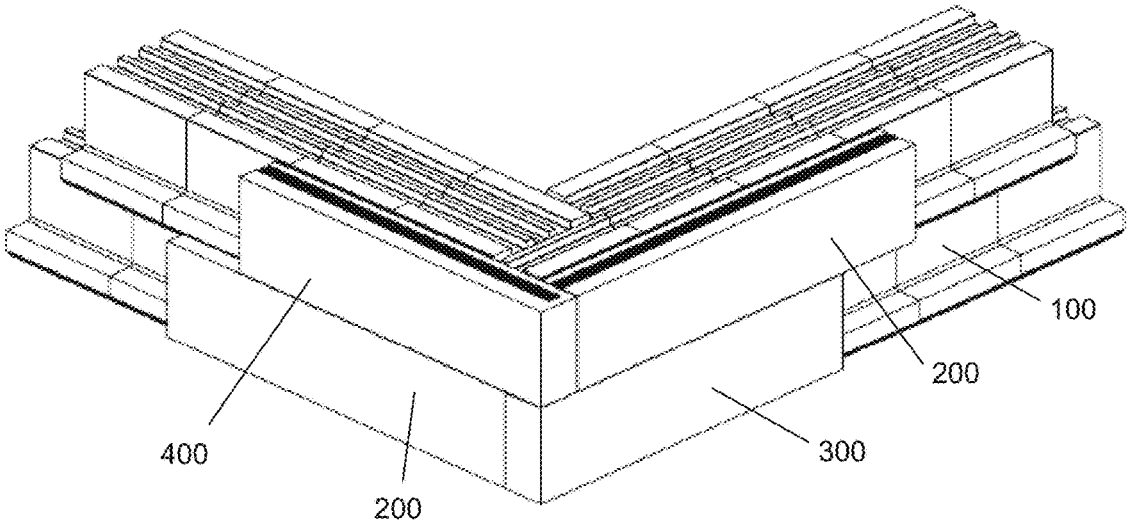
Figure 10E:
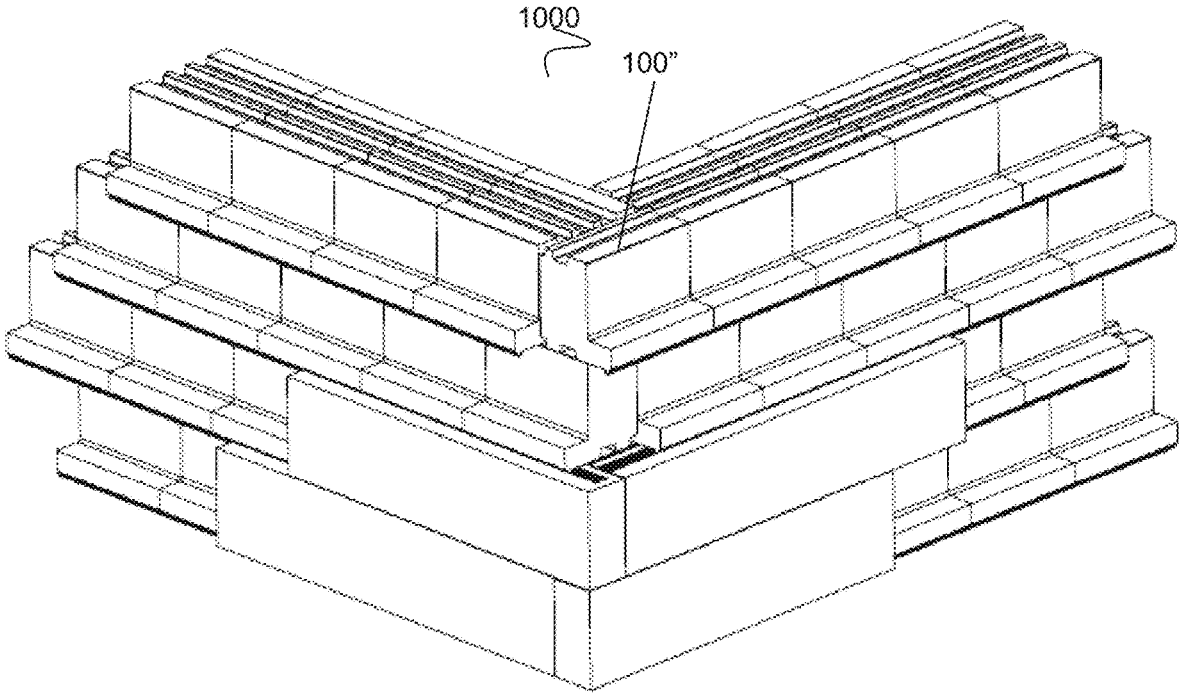

FIGS. 10A to 10E illustrate the construction of a corner assembly 1000 using single core blocks 100 and half core blocks 100". In FIGS. 10D and 10E note the use of right end 300 and left end 400 fascia blocks to create the corner of the front face of the corner assembly, followed by standard fascia blocks 200.

Figure 11:
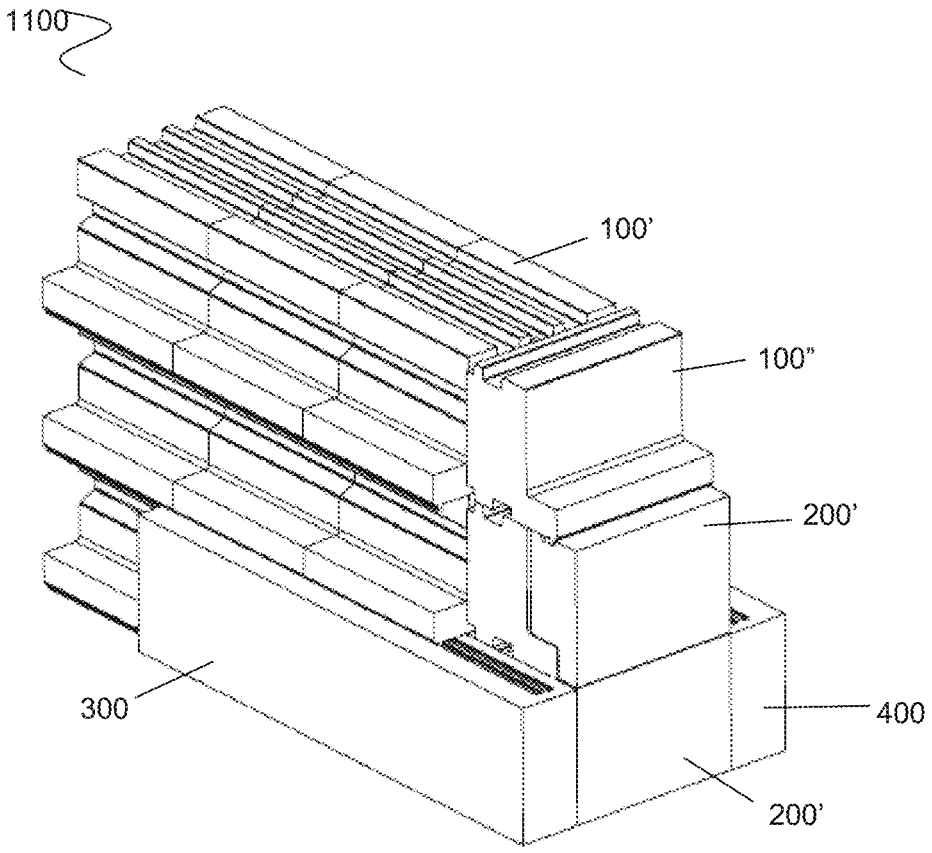
FIG. 11 illustrates a structure of double core blocks with end core block, left and right end fascia blocks and fascia end block according to one embodiment.

FIG. 11 illustrates a structure of double core blocks 100' with end core block 100", left 400 and right 300 end fascia blocks and fascia end block 200'.

FIG. 12 illustrates a structure of single cores 100 with base 600.

In another embodiment, the present disclosure provides for a kit comprising of a core block and a fascia block. The kit may also include the base 600 and/or the connector element 70. The kit may also include instructions for assembling the elements of the kit into one or more structures.

It is within the ambit of the present disclosure to provide any obvious modifications of the embodiment described herein, provided such modifications fall within the scope of the appended claims.

Those skilled in the art will recognize, or be able to ascertain using no more than routine experimentation, many equivalents to the specific embodiments of the invention described herein. Such equivalents are intended to be encompassed by the following claims.

The following claims are provided to add additional clarity to this disclosure. Future applications claiming priority to this application may or may not include the following claims, and may include claims broader, narrower, or entirely different from the following claims.

What is claimed is:

1. A kit for constructing a structure comprising:

(a) one or more core blocks, each core block having a front side face, a back side face, a left side face, a right side face, a top side face and a bottom side face, each core block having a shelf extending from a bottom portion of one or more of the front side face, the back side face, the left side face and the right side face, and (b) one or more fascia blocks, each fascia block having a front side face, a back side face, a right side face, a left side face, a top side face and a bottom side face, the back side face of each fascia block having a cut-out section, wherein the cut-out section of the fascia block is designed, sized or configured to mount to the shelf of the core block, and wherein a bottom face of the shelf includes a protrusion extending from a left side face of the shelf to a right side face of the shelf, and the top side face of each fascia block includes a groove extending from the left side face of the fascia block to the right side face of the fascia block configured to receive the protrusion of the shelf of the core block.

2. The kit of claim 1, wherein the shelf includes (i) the bottom face being aligned with the bottom side face of the core block, (ii) a top face, which orthogonally extends for a first distance from the front side face and/or the back side face of the core block, and (iii) a flat front face positioned parallel to the front side face of the core block and/or back face of the core block.

3. The kit of claim 1, wherein the cut-out section of the fascia block includes: (i) a horizontal top wall that orthogonally extends for a second distance from the back side face of the fascia block in a direction towards the front side face of the fascia block, but is terminated before reaching the front side face of the fascia block, and (ii) a vertical back wall orthogonally extending downwards from an end of the horizontal wall of the cut-out that is closer to the front side face of the fascia block than the back side face of the fascia block.

4. The kit of claim 3, wherein the first distance is longer than the second distance such that a gap between the side face of the core block having the shelf and the back side face of the fascia block is formed when the cut-out section of the fascia block is mounted to the shelf of the core block.

5. The kit of claim 1, wherein the top side face and bottom side face of each core block include at least one groove respectively for interlocking core blocks of the one of more core blocks together in stacked rows.

6. The kit of claim 1, wherein the shelf extends from the front side face and the back side face.

7. The kit of claim 1, wherein the shelf extends from the front side face.

8. The kit of claim 1, wherein at least one of the one or more core blocks includes a split line extending from the left side face to the right side face across the top side face of the core block and the bottom side face, and extending across the left and right side faces from the top side face to the bottom side face.

9. The kit of claim 1, wherein the top side face of each core block includes three parallel grooves: a front top groove, a back top groove and a middle top groove disposed between the front top groove and the back top groove, and wherein the bottom side face of each core block includes three parallel bottom grooves: a front bottom groove, a back bottom groove, and a middle bottom groove disposed between the front bottom groove and the back bottom groove, said grooves on the top side face and bottom side face having substantially identical cross-sections.

10. The kit of claim 9, wherein the front top groove is disposed opposite to the front bottom groove in an offset and overlapping relationship, the back top groove is disposed opposite to the back bottom groove in an offset and overlapping relationship, and the middle top groove and the middle bottom groove are disposed in an opposed aligned relationship.

11. The kit of claim 9, wherein the front top groove and back top grove are offset rearwardly a greater distance from the front side face of the core block than the front bottom groove and the back bottom grooves, and wherein the middle top groove and the middle bottom groove are disposed in an opposed aligned relationship.

12. The kit of claim 1, wherein the back side face of at least one of the one or more core blocks includes a cut-out or recess section that extends between the left side face to the right side face of the at least one core block.

13. The kit of claim 1, wherein the cut-out section of at least one of the one or more fascia blocks has a left side wall which is aligned with the left side face of the fascia block, such that a left end of the cut-out section is closed and a right side end of the cut-out section is open.

14. The kit of claim 1, wherein the cut-out section of at least one of the one or more fascia blocks has a right side wall which is aligned with the right side face of the fascia block, such that a right end of the cut out section is closed and a left end of the cut-out section is open.

15. The kit of claim 1, wherein the cut-out section of at least one of the one or more fascia blocks has a left side wall which is aligned with the left side face of the fascia block, such that a left end of the cut out section is closed and a right side wall which is aligned with the right side face of the fascia block, such that a right end of the cut out section is closed.

16. The kit of claim 1, wherein the top side face of each fascia block includes two or more grooves, each of the two or more grooves being configured to receive the protrusion of the shelf of the core block.

17. The kit of claim 1, wherein the kit further comprises one or more base blocks, each base block having a front side face, a back side face, a left side face and a right side face, a top side face and a bottom side face, the top side face having a groove that extends from the right side face to the left side face, the groove configured to integrate, assemble or couple with the bottom side face of the core block.

18. The kit of claim 1, wherein kit further comprises a connector element, and wherein the at least one groove of the top side face and at least one groove of the bottom side face of each core block is configured to receive at least a portion of the connector element therein, said core blocks of the one of more core blocks, when stacked on top of one another to form the structure, having at least one groove of the top side face aligned with one groove of the bottom side face with one or more of said connector elements disposed in and between said aligned grooves to retain said blocks aligned longitudinally and to prevent transverse displacement of said blocks.

19. The kit of claim 1, wherein a gap between the side face of the core block having the shelf and the back side face of the fascia block is formed when the cut-out section of the fascia block is mounted to the shelf of the core block.

20. A structure system comprising:

(a) a plurality of core blocks, each core block having a front side face, a back side face, a left side face, a right side face, a top side face and a bottom side face, each core block having a shelf extending from a bottom portion of one or more of the front side face, the back side face, the left side face or the right side face, and (b) a plurality of fascia blocks, each fascia block having a front side face, a back side face, a right side face, a left side face, a top side face and a bottom side face, the back side face of each fascia block having a cut-out section, wherein the cut-out section of the fascia block is mounted to the shelf of the core block, and wherein a bottom face of the shelf includes a protrusion extending from a left side face of the shelf to a right side face of the shelf and the top side face of each fascia block includes and the top side face of each fascia block includes a groove extending from the left side face of the fascia block to the right side face of the fascia block configured to receive the protrusion of the shelf of the core block.

21. The structure system of claim 20, wherein the shelf of each core block includes (i) the bottom face being aligned with the bottom side face of the core block, (ii) a top face, which orthogonally extends for a first distance from the front side face and/or the back side face of the core block, and (iii) a flat front face positioned parallel to the front side face of the core block and/or back face of the core block.

22. The structure system of claim 20, wherein the cut-out section of each fascia block includes: (i) a horizontal top wall that orthogonally extends for a second distance from the back side face of the fascia block in a direction towards the front side face of the fascia block, but is terminated before reaching the front side face of the fascia block, and (ii) a vertical back wall orthogonally extending downwards from an end of the horizontal wall of the cut-out that is closer to the front side face of the fascia block than the back side face of the fascia block.

23. The structure system of claim 22, wherein the first distance is longer than the second distance such that a gap between the side face of the core block having the shelf and the back side face of the fascia block is formed when the cut-out section of the fascia block is mounted to the shelf of the core block.

24. The structure system of claim 20, wherein the top side face and bottom side face of each core block include at least one groove respectively for interlocking core blocks of the plurality of core blocks together in stacked rows.

25. The structure system of claim 20, wherein the shelf extends from the front side face and the back side face of the core block.

26. The structure system of claim 20, wherein the shelf extends from the front side face of the core block.

27. The structure system of claim 20, wherein at least one of the plurality of fascia blocks is mounted to span across a horizontal joint between adjacent core blocks of the plurality of core blocks and to span across a vertical joint between adjacent core blocks of the plurality of core blocks.

28. The structure system according to claim 20, wherein the top side face of each fascia block includes a front row groove and a back row groove, the front and back row grooves being parallel to one another and extending from the left side face to the right side face of the top side face of ach fascia block, the front row groove being disposed closer to the front side face of the fascia block relative to the back row groove, each of the front row and back row grooves being configured for coupling with the protrusion of the shelf of the core block.

29. The structure system of claim 28, wherein the core blocks of the plurality of core blocks are disposed in an assembly such that the protrusion of the bottom face of the shelf is coupled to the back row groove of the fascia block to align the front side faces of the fascia blocks of the plurality of fascia blocks in a vertical plane.

30. The structure system of claim 28, wherein the core blocks of the plurality of core blocks are disposed in an assembly such that the protrusion of the bottom face of the shelf is coupled to the front row groove of the fascia block to align the front faces of the fascia blocks of the plurality of fascia blocks in a battered assembly.

31. The structure system of claim 20, wherein the top side face of each core block includes three parallel grooves: a front top groove, a back top groove and a middle top groove disposed between the front top groove and the back top groove, and wherein the bottom side face of each core block includes three parallel bottom grooves: a front bottom groove, a back bottom groove, and a middle bottom groove disposed between the front bottom groove and the back bottom groove, said grooves on the top side face and bottom side face having substantially identical cross-sections.

32. The structure system of claim 31, wherein the front top groove is disposed opposite to the front bottom groove in an offset and overlapping relationship, the back top groove is disposed opposite to the back bottom groove in an offset and overlapping relationship, and the middle top groove and the middle bottom groove are disposed in an opposed aligned relationship.

33. The structure system of claim 32, wherein the core blocks of the plurality of core blocks are disposed in an assembly such that the middle top grooves in the top face are aligned vertically with the middle bottom grooves to align the front side faces of each core block in the assembly in a vertical plane.

34. The structure system of claim 32, wherein the core blocks of the plurality of core blocks are disposed in an assembly such that the front top grooves in the top face are aligned vertically with the front bottom grooves to align the front faces of each core block in a battered assembly.

35. The structure system of claim 32, wherein the core blocks of the plurality of core blocks are disposed in an assembly such that the back top grooves in the top face are aligned vertically with the back bottom grooves to align the front side faces of each core block in a battered assembly.

* * * * *